US006361230B1

(12) United States Patent
Crystal et al.

(10) Patent No.: US 6,361,230 B1
(45) Date of Patent: Mar. 26, 2002

(54) PRINTING ZONE SPECIALLY ADAPTED FOR TEXTILE PRINTING MEDIA

(75) Inventors: Kevin Reed Crystal, Chanhassen; Aaron Gerald Barclay, Prior Lake, both of MN (US)

(73) Assignee: MacDermid Acumen, Inc., Waterbury, CT (US)

( * ) Notice: Subject to any disclaimer, the term of this patent is extended or adjusted under 35 U.S.C. 154(b) by 0 days.

(21) Appl. No.: 09/451,692

(22) Filed: Nov. 30, 1999

Related U.S. Application Data

(60) Provisional application No. 60/154,503, filed on Sep. 17, 1999.

(51) Int. Cl.[7] ..... B41J 15/08

(52) U.S. Cl. ..... 400/615; 347/104

(58) Field of Search ..... 400/613, 615, 400/615.1, 615.2, 617, 618, 583; 347/101, 104

(56) References Cited

U.S. PATENT DOCUMENTS

| | | | | | |
|---|---|---|---|---|---|
| 3,904,145 | A | * | 9/1975 | Steinberger et al. | 242/75.2 |
| 5,751,303 | A | * | 5/1998 | Erickson et al. | 347/16 |
| 5,764,264 | A | * | 6/1998 | Takanaka | 347/104 |
| 5,825,374 | A | * | 10/1998 | Albertalli et al. | 346/136 |
| 5,882,131 | A | * | 3/1999 | Belon et al. | 400/662 |
| 5,938,354 | A | * | 8/1999 | Yasui et al. | 400/621 |

OTHER PUBLICATIONS

U.S. application, No. 09/451396, Jankovich et al., filed Nov. 30, 1999.

U.S. application, No. 09/451694, Jankovich et al., filed Nov. 30, 1999.

U.S. application, Ser. No. 09/452324, Lidke et al., filed Nov. 30, 1999.

U.S. application, No. 09/452324, Crystal, filed Nov. 30, 1999.

* cited by examiner

*Primary Examiner*—Ren Yan
(74) *Attorney, Agent, or Firm*—Carmody & Torrance LLP

(57) ABSTRACT

The method and apparatus of the present invention increases the precision for controlling diverse printing substrates during printing operation while ink is emitted from an ink jet print head to form patterns upon the printing media substrate. The present invention addresses several long-standing obstacles to high quality printed output upon many nontraditional print media, including media handling for nonbacked, unsupported, fibrous print media. The print media traverses the engine in a complex pathway in the preferred embodiment; including, continually advancing from a powered media supply roll through a cross-web tensioning area, an idler pulley, then over a full-web media advance grit roller, through a unique "open web" printing zone—where the media is briefly suspended during application of ink, over an idler pulley, through a forced heating zone (preferably dual-sided), and then over another idler pulley, and finally onto a take-up spool which is biased against the force created by the powered media supply spool. The engine of the present invention utilizes this open-web printing zone, dual forced air heating of both sides of freshly printed media, and a continuously biased tension in the axial web directions and cross-web directions for maximum effect on fibrous media in particular, although the system lends itself to use in ink jet graphics arts applications. The media is preferably loaded in a center-justified orientation and the engine is tolerant of traditionally produced textile media rolls, cores, and fabric varieties. A removeable pad may optionally be disposed on top of a platen frame member and under the print media pathway so that any ink that penetrates a porous media in the open web print zone impinges upon the pad where it can be collected and disposed of properly. If placed proximate to the printing media pathway, the removeable pad furthermore reduces the amplitude of any media wrinkles and thereby reduces drop placement errors which might cause visual artifacts.

20 Claims, 34 Drawing Sheets

PRINTING ZONE SPECIALLY ADAPTED FOR TEXTILE PRINTING MEDIA

This patent application claims the benefit of and depends in part upon U.S. provisional patent application Ser. No. 60/154,503 filed September 17, 1999, by Lidke et al. the entire disclosure of which is incorporated by reference herein. Also incorporated herein by reference are four related U.S. utility patent applications filed on even day herewith and assigned the following titles (with the corresponding application serial number noted in parentheses), "Auxiliary Underside Media Dryer," (Ser. No. 09/452,323); "Full-Web Grit Roller For A Large Format Ink Jet Print Engine" (Ser. No. 09/452,324); "Apparatus For Maintaining Web Tension In A Textile Printing Medium Disposed In An Ink Jet Print Engine", (Ser. No. 09/451,503); and "Apparatus For Imparting Cross-Web Media Tension In An Ink Jet Print Engine" (Ser. No. 09/451,396).

FIELD OF THE INVENTION

The present invention relates generally to the field of printing. In particular, a method and apparatus for printing upon diverse media including standard graphics arts coated ink jet print media materials, but especially fibrous and woven materials (e.g., textiles) with a specially adapted wide format in drop-on-demand ink jet print engine.

BACKGROUND OF THE INVENTION

The present invention addresses issues presented in adapting thermal drop-ondemand ink jet printing techniques for applying colorant to printing media that fails to trap all the ink emitted onto the surface of the printing media (this includes perforated print media materials, blown fiber materials, and textile materials, to name just a few).

In the prior art related to textile printing typically vast amounts of ink are rapidly applied to rapidly moving fiber substrates (temporarily adhered to a moving belt) via a set of rotary screens each having a desired pattern associated therewith. The colors of the ink are known as "spot" color inks and they do not typically interact with other colors to form intermediate colored prints. By adding different colors and/or patterns the textiles eventually are rendered in a final design. The textile material is then typically exposed to heat and/or water vapor or other catalyst to fix the ink to the textile fibers. In the case of reactive inks the textile fibers actually chemically bond to the ink molecules during this step so that the final printed product is permanently marked and may be thereafter repeatedly washed without significant degradation of the printed product.

In ink jet printing a print head operated under precise electronic control typically opposes a portion of printing media so that an image may be printed thereon. The present invention addresses ink jet printing upon textiles.

In a traditional ink jet printing a roll of media attaches to a rotating supply spool and then passes under one or more discrete ink emitting print elements ("nozzles") in a printing zone which is essentially a platen secured so that a carriage articulated in the axial direction reciprocates thereacross. The printing media is rigidly coupled to a substantially planar surface and the nozzles are articulated to cover the media over the width of the media. In a reciprocating carriage-base print engine the media is incrementally stepped over a platen surface in one direction while the nozzles reciprocate across the media in a direction orthogonal to direction the media advances.

Thus, a need exists in the art of digital ink jet printing to advance the state of the art for emitting ink droplets in order to improve the quality and the visual clarity of text, graphics, and color appearing on textile media. Further, a need exists in the prior art to solve issues related to the performance limitations of known non-specialized print engines which emit ink from nozzles onto a printing media. Finally, a need exists in the art to improve the yield of quality digital output given mechanical constraints imposed by use of ink emitting print heads mounted at some distance above a printing media so that ink droplets reach a location on the printing media as close as possible to the preselected location associated with the primary droplet and are dried prior to being wrapped upon a take-up spool.

SUMMARY OF THE INVENTION

The method and apparatus of the present invention increases the precision for controlling diverse printing substrates during printing operation while ink is emitted from an ink jet print head to form patterns upon the printing media substrate. The present invention addresses several long-standing obstacles to high quality printed output upon many nontraditional print media, including media handling for nonbacked, unsupported, fibrous print media. The print media traverses the engine in a complex pathway in the preferred embodiment; including, continually advancing from a powered media supply roll through a cross-web tensioning area, an idler pulley, then over a full-web media advance grit roller, through a unique "open web" printing zone—where the media is briefly suspended during application of ink, over an idler pulley, through a forced heating zone (preferably dual-sided), and then over another idler pulley, and finally onto a take-up spool which is biased against the force created by the powered media supply spool.

The engine of the present invention utilizes this open-web printing zone, dual forced air heating of both sides of freshly printed media, and a continuously biased tension in the axial web directions and cross-web directions for maximum effect on fibrous media in particular, although the system lends itself to use in ink jet graphics arts applications. The media is preferably loaded in a center-justified orientation and the engine is tolerant of traditionally produced textile media rolls, cores, and fabric varieties.

A removeable pad may optionally be disposed on top of a platen frame member and under the print media pathway so that any ink that penetrates a porous media in the open web print zone impinges upon the pad where it can be collected and disposed of properly. If placed proximate to the printing media pathway, the removeable pad furthermore reduces the amplitude of any media wrinkles and thereby reduces drop placement errors which might cause visual artifacts.

After printing, the textile media typically requires post treatment, such as a process of steaming the textile and/or washing the printed textile in a solution of soap and water to remove excess colorant.

A preferred technique of operating the powered supply spool and the biased take-up spool is disclosed in U.S. Pat. No. 5,751,303 issued to Erickson et al. and entitled, "Printing Medium Management Apparatus," the entire contents of which is incorporated herein by reference. Briefly, this patent reference teaches use of opposing low torque motors driving the supply and take-up spools of an ink jet print engine so that a consistent web tension is maintained during printing operations. In the context of the present invention, this technique proves extremely useful because particularly when printing upon diverse un-backed textile media inherently creates problems with a stable web tension so that the media does not snag on one or more portions of the media handling mechanism(s) when energized.

The present invention furthermore preferably utilizes salvage edge maintenance members that provide a couple of features and benefits to the process of ink jet printing upon textile substrates. First, the edges of many print media, particularly textile materials, are often irregular and have a tendency to curl thereby creating a tendency for the extremely sensitive orifice plates of thermal ink jet cartridges to impinge thereon, thus potentially damaging the cartridges and likely ruining at least that particular section of printing substrate with undesirable ink droplets and smearing of ink from the orifice plates.

A print engine built along the lines suggested and taught herein will preferably handle at least sixty-three inch (63") width print media (although scaling the present invention beyond this width is reasonably foreseeable), has a center-justified loading and printing configuration, and an "auto-locking" nip roller assembly proximate the full-web grit roller member for ease of media loading. Furthermore, such a print engine preferably handles three inch (3") diameter supply spools ("cores") presently commonly utilized in the textile printing industry and should support media having irregular edges as well as partial interior cores made of cardboard or similar material. Also, such a print engine preferably utilizes many print heads, with twelve (12) to sixteen (16) discrete disposable thermal ink jet print cartridges operating in concert to rapidly and accurately print myriad colors, patterns and text upon diverse textile media material(s).

DESCRIPTION OF THE DRAWINGS

The several figures submitted herewith all relate to a preferred embodiment of a complete large format digital ink jet print engine and the assemblies and subassemblies related thereto. In the perspective views presented herewith oftentimes the carriage assembly, which houses thermal ink jet cartridges and related circuitry for energizing the cartridges are omitted so that the fundamental features of the print engine are more readily discernible. Likewise, the textile media, media support bars (supply and take-up) are omitted from most every view depicted herein for ease of viewing of the features of the print engine.

The following figures are not drawn to scale and only detail a few representative embodiments of the present invention, more embodiments and equivalents of the representative embodiments depicted herein are easily ascertainable by persons of skill in the digital imaging arts.

DESCRIPTION OF PREFERRED EMBODIMENT

Figure 1:
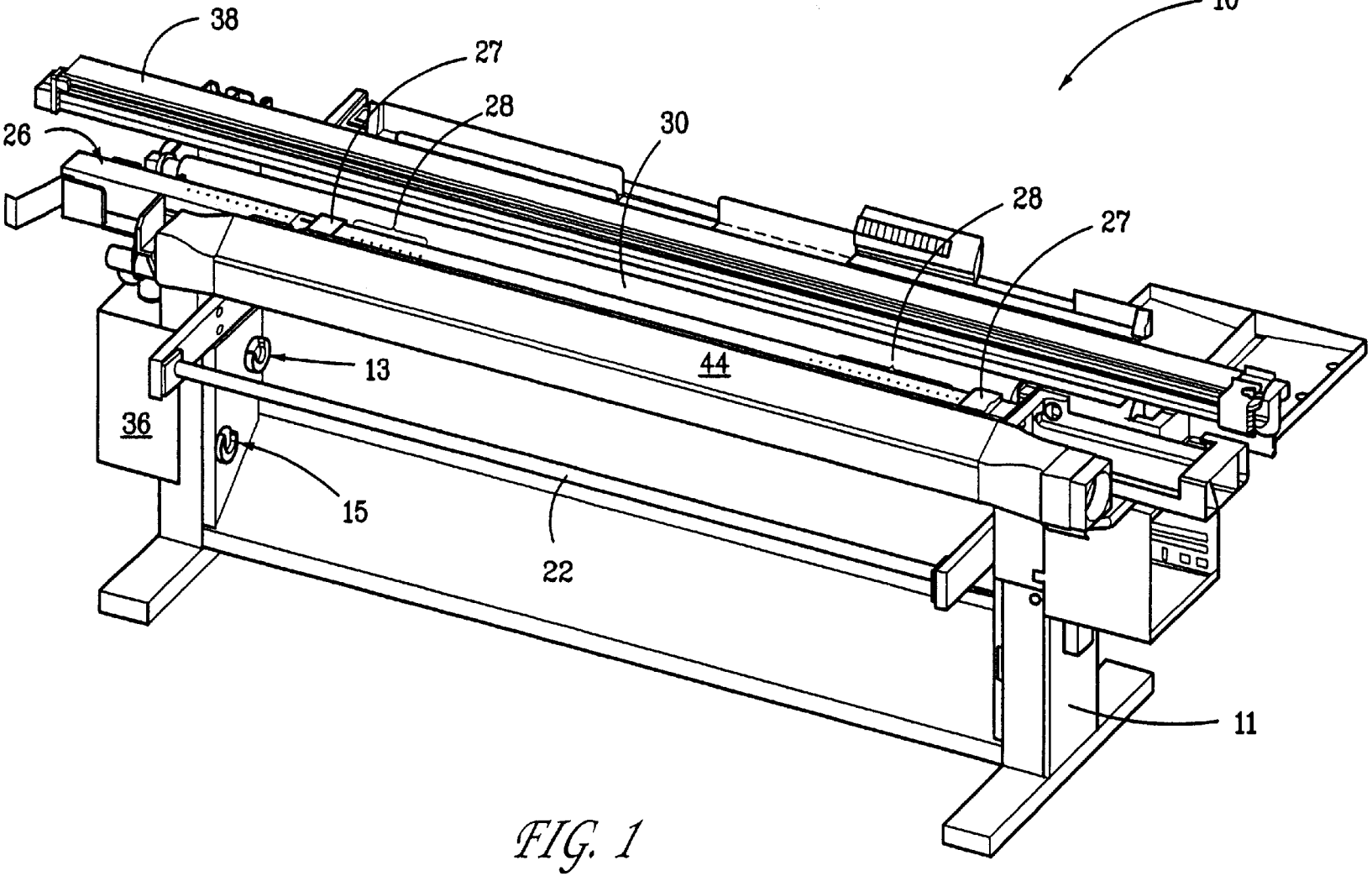
FIG. 1 depicts a perspective view looking downward at an embodiment of the large format thermal ink jet print engine manufactured in accordance with the teaching herein.

The method and apparatus of the present invention increases the precision for controlling diverse textile printing substrates during printing operation while ink is emitted from an ink jet print head to form patterns upon the textile substrate. The present invention addresses several long-standing obstacles to high quality printed textile output including media handling from a powered media supply roll, through a cross-web tensioning area, an idler pulley, then over a full-web media advance grit roller, through a printing zone, over an idler pulley, through a forced heating zone (preferably dual-sided), and then over another idler pulley, and finally onto a take-up spool which is biased against the force created by the powered media supply spool.

After printing, the textile media typically requires post treatment, such as a process of steaming the textile and/or washing the printed textile in a solution of soap and water to remove excess colorant.

A preferred technique of operating the powered supply spool and the biased take-up spool is disclosed in U.S. Pat. No. 5,751,303 issued to Erickson et al. and entitled, "Printing Medium Management Apparatus," the entire contents of which is incorporated herein by reference. Briefly, this patent reference teaches use of opposing low torque motors driving the supply and take-up spools of an ink jet print engine so that a consistent web tension is maintained during printing operations. In the context of the present invention, this technique proves extremely useful because printing upon diverse un-backed textile media inherently creates problems with a stable web tension so that no ripples in the media traverse the print zone and so that the media does not snag on one or more portions of the media handling mechanism(s) when energized.

The print engine 10 of the present invention furthermore preferably utilizes salvage edge maintenance members 27 that provide a couple of features and benefits to the process of ink jet printing upon textile substrates. First, the edges of textile media are often irregular and have a tendency to curl thereby creating a tendency for the extremely sensitive orifice plates of thermal ink jet cartridges to impinge thereon, thus potentially damaging the cartridges and likely ruining at least that particular section of printing substrate with undesirable ink droplets and smearing of ink from the orifice plates.

A print engine 10 built along the lines suggested and taught herein will preferably handle at least sixty-three inch (63") width textile media, has a center-justified loading and printing configuration, and an "open web" print zone between a full-web roller member 30 and a second full-web roller 32. Furthermore, such a print engine handles three inch (3") diameter (typically cardboard) core members presently commonly utilized in the textile printing industry and support media having irregular edges as well as partial interior cores made of cardboard or similar material due to a spiral grooves 17, 19 preferably formed in the supply spool 12 and the take up spool 14 (see FIG. 25). These spiral grooves 17, 19 are designed to mechanically cooperate with a set of substantially cylindrical yoke members each having pegs extending (not shown) to engage the grooves 17, 19 and thereby continually bias each yoke member against an end of the hollow core.

In addition, such a print engine preferably employs a service station for cleaning, wiping, and capping the ink jet cartridges so that the cartridges recover rapidly following overnight or extended periods of non-printing. Also, such a print engine preferably utilizes many print heads, with twelve (12) to sixteen (16) discrete disposable thermal inkjet print cartridges operating in concert to rapidly and accurately print myriad colors, patterns and text upon diverse textile media material(s). Finally, the print engine preferably employs techniques for calibration and registration of the many print heads operating therein. When printing upon textile print media or any material have fibers such a service station preferably removes any loose fibers (akin to lint) that might accumulate on or near in emitting nozzles 43 of cartridges 40 operating in the print engine 10. Such a service station preferably utilizes bristle material in lieu of or in addition to the traditional wiping action to remove ink from an ink emitting orifice plate and to clean the surfaces surrounding ink emitting nozzles 43.

The present invention is first described primarily with reference FIG. 1, which depicts a perspective view of an embodiment of the large format thermal ink jet print engine 10 manufactured in accordance with the teaching herein. The print engine 10 depicted herein is a highly preferred embodiment of the present invention, particularly with respect to the cross-web tensioning means taught herein. The caveats presented above at the "Description of the Drawings" section of this patent application apply to FIG. 1 through FIG. 33.

In FIG. 1, the print engine is supported by a base/frame assembly 11. Mounted on the frame 11 are opposing supply spool cams 13 and opposing take-up spool cams 15. A supply spool motor (not depicted in FIG. 1) and take-up spool motor (not depicted in FIG. 1) are mechanically coupled to said cams 13, 15 and provide a low torque biasing said cams in opposite directions to thereby impart a slight tension to the web of media (not shown) connected therebetween.

First and second supply side idler rods 20,21 are disposed so that the media wraps around each prior to wrapping onto a powered full web-width grit roller 30 so that the media has an opportunity to stretch and become as flat as possible prior to wrapping around the roller 30. The roller 30 is powered and is the primary source of media advance. The roller 30 is coupled to a rotary encoder-equipped drive motor and is directly driven by a belt attached thereto (not shown). In operation, the media traverses from the roller 30 across an open-web print zone (wherein the media does not contact any surfaces) prior to wrapping around a passive large diameter idler roller 32. Spaced below the plane of the media web in the print zone is a print zone frame member 26 having a plurality of peg-receiving ports for receiving peg members associated with at least two salvage edge members 27. The salvage edge members 27 can thus be adjusted for a variety of media sizes so that the edges of media cannot bend, or curl, and thus avoids print head strikes during printing operations. In one embodiment, the salvage edge members 27 are S-shaped and are sized to mount to the print zone frame member 26 at one end so that the upper side of the edge member 27 is approximately at the plane of the media over, or in, the printing zone.

After the media wraps around the passive large diameter idler roller 32 it is directed to wrap around a take-up side idler roller 22. In the web defined by the area between roller 32 and roller 22, two sources of heated, forced air are directed to opposing sides of the freshly printed media. The upper heater plennum assembly 44 is coupled to a preferably rotary molded member that spans the width of the media and has a heater/fan combination 36 assembly at each end of the plennum 44. The plennum is constructed as in the heater assembly for the DisplayMaker Series XII printer designed and manufactured by ColorSpan Corporation of Eden Prairie, Minn., USA. The lower heater plennum 34 is preferably a round portion of extruded resin based material with a series of elongate ports cut therein and is coupled to a single blower source and a single heater source combined into a single unit which is preferably mechanically attached to the base member 11 of the engine 10. In operation, both heaters 34,44 provide a constant heated flow of air over the freshly printed media surface to thereby ensure adequate drying occurs prior to the media being wound upon the take-up spool 14.

In a preferred embodiment, a means of creating a cross-web tension in the media just after the media is unwound from the supply spool 12 is applied to remove small creases and wrinkles from the media and to generally stabilize the media prior to emitting ink thereon. This means can have at least two different embodiments, and these two embodiments are not necessarily exclusive in operation, so both could be applied and used in any given engine designed, built, and operated using the teaching supplied herein. In one embodiment, a single powered axial shaft is interposed between the supply spool 12 of media and the first idler roller 20 and is energized to turn at a constant rate. To impart opposing cross-web tension to the media web, the shaft is wrapped with a resin-based (basically tacky-surfaced) length of tubing or rope, and the tubing is inserted and tied (or simply fixed) at each end of the shaft. Preferably the middle portion of the shaft has another connecting point for the tubing so that when the shaft turns the tubing biases the media toward its peripheral edges like a screw member. In another embodiment, two such shafts are spaced apart but nearly in contact with each other and each has similar wraps of tubing to impart the biasing force to the web to create cross-web tension and thus remove wrinkles and creases. The selection of the tubing material can be optimized for various media materials and is preferably easily replaceable and adjustable (in terms of the number of wraps of tubing on the shaft(s)). Furthermore, the diameter and surface characteristics of the tubing material can be adjusted or selected as desired by the operator of the engine 10.

Likewise, with respect to the full-web grit roller 30, a variety of surface coatings may be applied to maximize the 'bite' imparted to the media while preserving the media itself from snags, tears, and the like. In one embodiment, flame cured/applied tungsten particles may be used (as are traditionally used for grit rollers in the typical ink jet print engine design and manufacturing), a resin-based material, adhesive material, and the like may be coated on the powered roller 30.

With respect to the passive large diameter full-web idler roller 32, for cost and perhaps efficiency, the roller 32 may be eliminated and replaced by an extruded portion of the print zone frame member 26. This would also preferably include an edge portion 75 adapted to use in a single pass cutting instrument (not shown) over a lower edge of said edge portion. In this embodiment, the edge should be highly polished and preferably define a slight arc, similar to the original roller 32 so that the media is not stretched or distorted as it passes over the edge portion.

With respect to the second supply side idler roller 21, a set of mounting cams 24 are preferably formed so they receive a peg at each end of the roller 21 in a groove of said cam 24 with the effect that as the media is advance following loading of the media. The roller 21 (and media wrapped thereacross) 'snaps' into close proximity to the full-web grit roller 30. The advantage to this mounting technique for the roller 21 is that the media can be manually threaded between the roller 21 and the grit roller 30 at the time of media loading with a space for the operator's fingers to feed the media through. Thereafter, when the media is completely 'strung' across the spools, idler rollers, and grit roller and the media advance mechanism is energized, the roller 21 literally 'snaps' into place.

Another mechanism for imparting cross-web tension to the media in the web between the supply spool 12 and the full-web grit roller 30 is the use of a set of cooperating wheels having at least three degrees of freedom. In essence, each wheel is adjustably mounted at or near the edge of the media using a first biased thumb screw coupled to a rail member. Then a second biased screw is used to deflect a cantilevered spatula member with a desired amount of force to urge a wheel member into contact with the media edge portion. A final biased screw member is adjusted to align the wheel with a desired amount of angular deflection from the media advance direction to thereby impart the needed cross-web tension to the media.

The following brief descriptions of the drawings of various embodiments of the present invention are designed to further assist the readers' comprehension of the many embodiments of the present invention. Many other embodiments may be derive from the teaching hereof and all insubstantial modifications therein are intended to be covered hereby.

Figure 2:
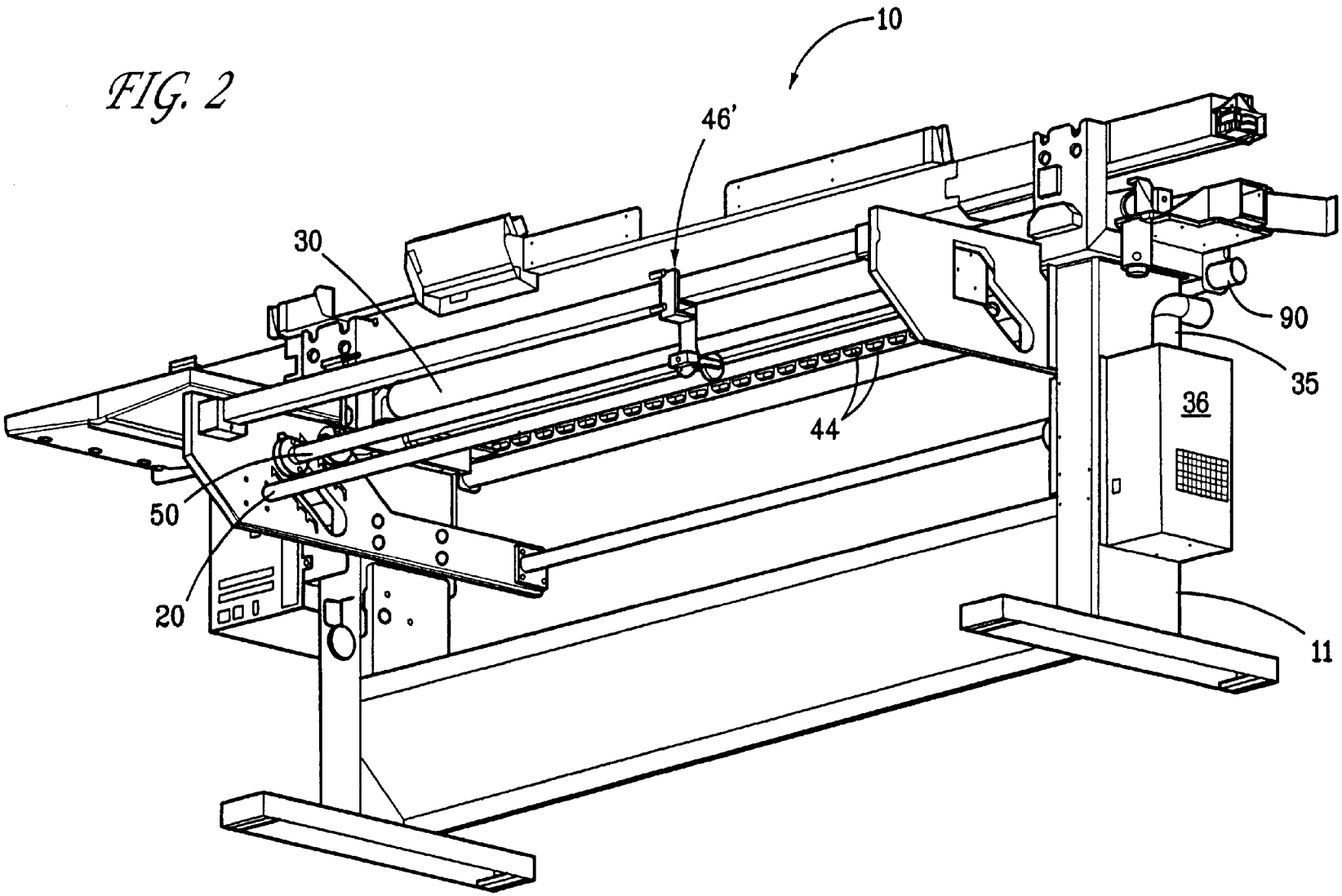
FIG. 2 depicts a perspective view looking upward at the media supply side of an embodiment of the large format thermal ink jet print engine that utilizes two means of creating and maintaining cross-web tension in the printing media prior to depositing ink thereon and which was manufactured in accordance with the teaching herein.

FIG. 2 depicts a perspective view looking upward at the media supply side of an embodiment of the large format thermal ink jet print engine 10 that utilizes two means of creating and maintaining cross-web tension in the printing media 50/52 and 46' prior to depositing ink thereon. Furthermore, the exit ports for the upper side dryer plenum 44 are shown in FIG. 2. The heater/fan combination assembly 36 housed in a shielded box attached to the frame 11 and having air pathway sections 90 and 35 depicted therein (in an uncoupled state to illustrate size of air tunnel. Note that heater/fan combination unit 36 could comprise an in-line unit except that for in the present embodiment, lateral size constraints dictated an off-axis approach to the location of the heater/blower unit 36. First powered spreader roller 50 is shown having an optional, adjustable mounting bracket used for varying the angle of deflection of a print media between the first idler roller 20 and second powered spreader roller 52. This embodiment is a manual adjustment of several degrees or arcuate travel designed not to disrupt the operation of the media advance system, regardless of the setting for the first powered spreader roller 50. In practice, the inventors found that an unadjustable setting having an offset of several degrees of deflection was adequate to create the desired cross-web tension (i.e., decrease and eliminate formation of print media wrinkles in the axial, or web advance, direction). The spreader bars 50, 52 have cord mounting ports 56 disposed near the center and near the ends of the spreader bars so that corded material may be attached at the center ports 56 and wound toward the ends where the cord is also attached. The corded material is preferably wound in opposing directions radiating from the center anchor location on spreader bar 50, and wound in a similar manner, but in reverse on spreader bar 52 to thereby maximize the constant "sine wave" like forces toward the edges of the media. Also depicted in FIG. 2 is an embodiment of a wheeled assembly 46' for imparting cross-web tension at the edges of the media by providing an angled wheel contact patch at or near the edge of the media that continually promotes cross-web tension in the print media. Another, more preferred embodiment of such a wheeled assembly is depicted herein at FIGS. 26–28, but both embodiments share some what similar geometry and purpose; namely, they both have first adjustment means for horizontal adjustment along a rail (57) and a projection adjustment controlling the amount that the wheel projects forward toward an idler roller 20 and a third adjustment for "angle of attack." That is, the angle at which the wheel is oriented in a direction of several degrees from an parallel path to the media advance direction.

Figure 3:
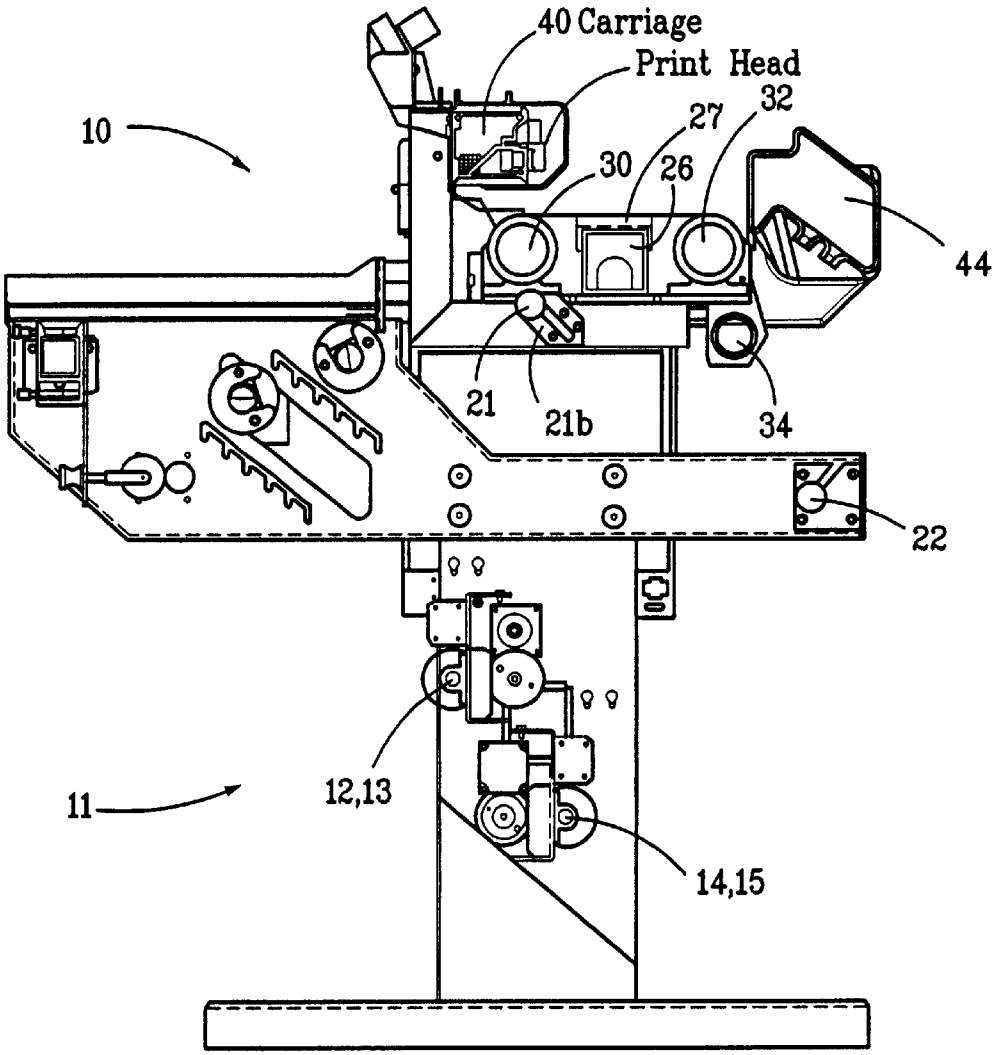
FIG. 3 depicts an elevational side view illustrating the relationship between the supply of media retained on low-torque powered supply spool, a first idler pulley with a wheel biased on a media edge portion, a first and second cross-web tension pair of powered rollers having cord material coiled in opposite directions from the center of each powered roller to impart cross-web tension in the print media, a full-web powered roller (referred to as a "grit" roller herein) for precisely advancing the print media, an "open web" printing zone between the full-web powered roller and a second roller, an upperside and an underside heated media drying apparatus, another idler roller, and finally, the take up core retained on the take-up spool which is also powered by a low-torque motor biased against the low-torque motor coupled to the supply spool.

FIG. 3 depicts an elevational side view illustrating the relationship between the supply of media retained on low-torque electric motor-powered supply spool 12, a first idler pulley 20 with a wheel (60 in FIG. 28) biased on a media edge portion, a first and second cross-web tension pair of powered rollers 50,52 having cord material (not shown) coiled in opposite directions from the center of each powered roller 50,52 to impart cross-web tension in the print media, a full-web powered roller 30 (referred to as a "grit" roller herein but which is essentially a "media drive" roller) for precisely advancing the print media, an "open web" printing zone between the full-web powered roller 30 and a second roller 32, an upperside 44 and an underside 34 heated media drying apparatus, another idler roller 22, and finally, the media core retained on the take-up spool 14 which is also powered by a low-torque motor (not shown) which is biased against the low-torque motor coupled to the supply spool 12 to provide a measure of print web rigidity throughout the print media handling system.

Figure 4:
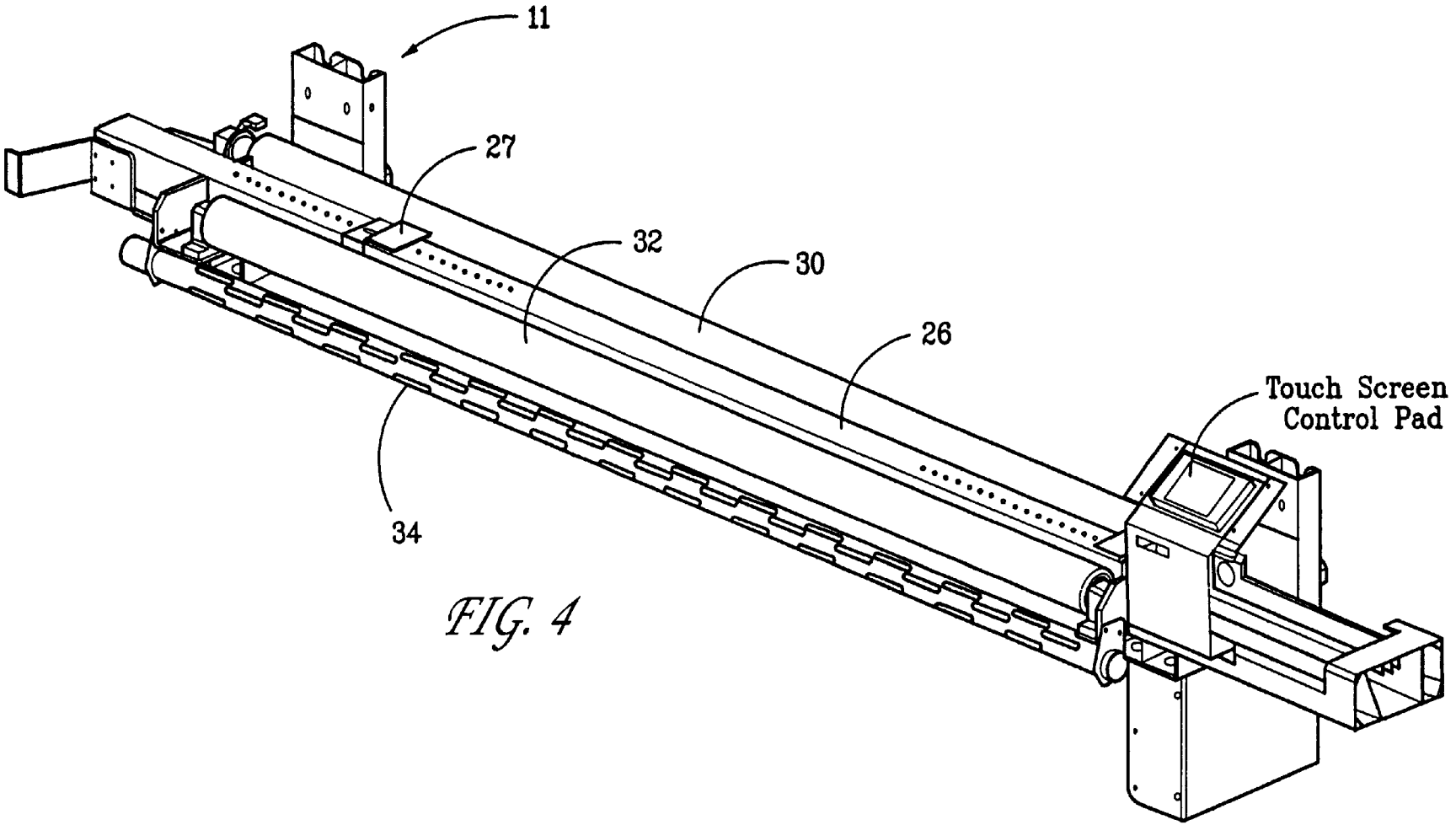
FIG. 4 is a perspective view depicting partial assembly of the powered full-web roller, platen frame member with adjustable salvage edge members, second full-web roller, and an underside dryer assembly having exit apertures for expelling heated air which impinges upon the unprinted underside of freshly printed print media during printing operations.

FIG. 4 is a perspective view depicting partial assembly of the powered full-web roller 30, platen frame member 26 with adjustable salvage edge members 27, second full-web roller 32, and an underside dryer assembly 34 having exit apertures for expelling heated air which impinges upon the unprinted underside of freshly printed print media during printing operations.

Figure 5:
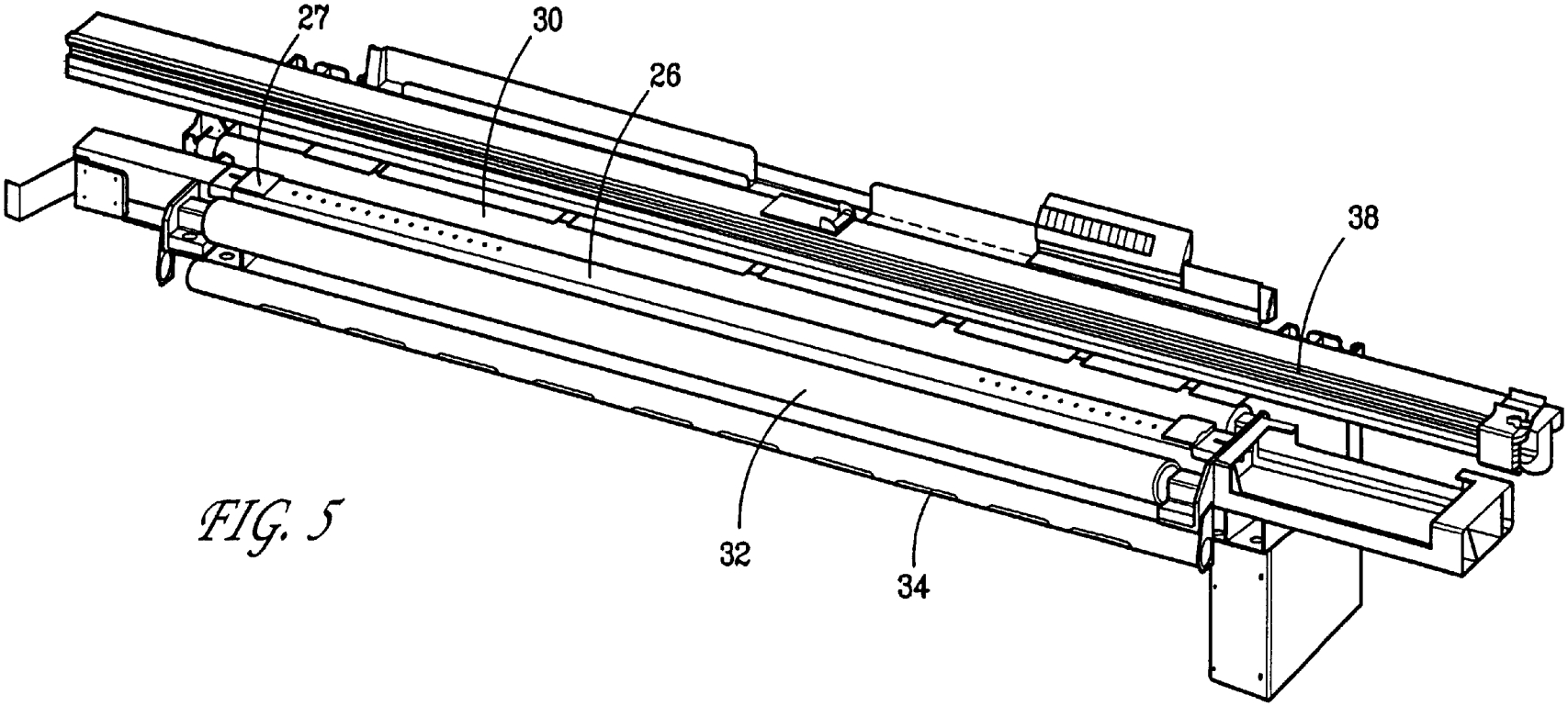
FIG. 5 is a perspective view similar to FIG. 4 but additionally depicting an upper rail member which supports a flexible chain member which in turn retains ink tubing and electrical conduit and which couples the print engine electronics to the print cartridges disposed in the reciprocating carriage assembly (not shown in FIG. 5).

FIG. 5 is a perspective view similar to FIG.4 but additionally depicting an upper rail member 38 which supports a flexible chain member which in turn retains ink tubing and electrical conduit (not shown) and which couples the print engine electronics (not shown) to the print cartridges 40 disposed in the reciprocating carriage assembly (39 elsewhere depicted although not shown in FIG. 5).

Figure 6:
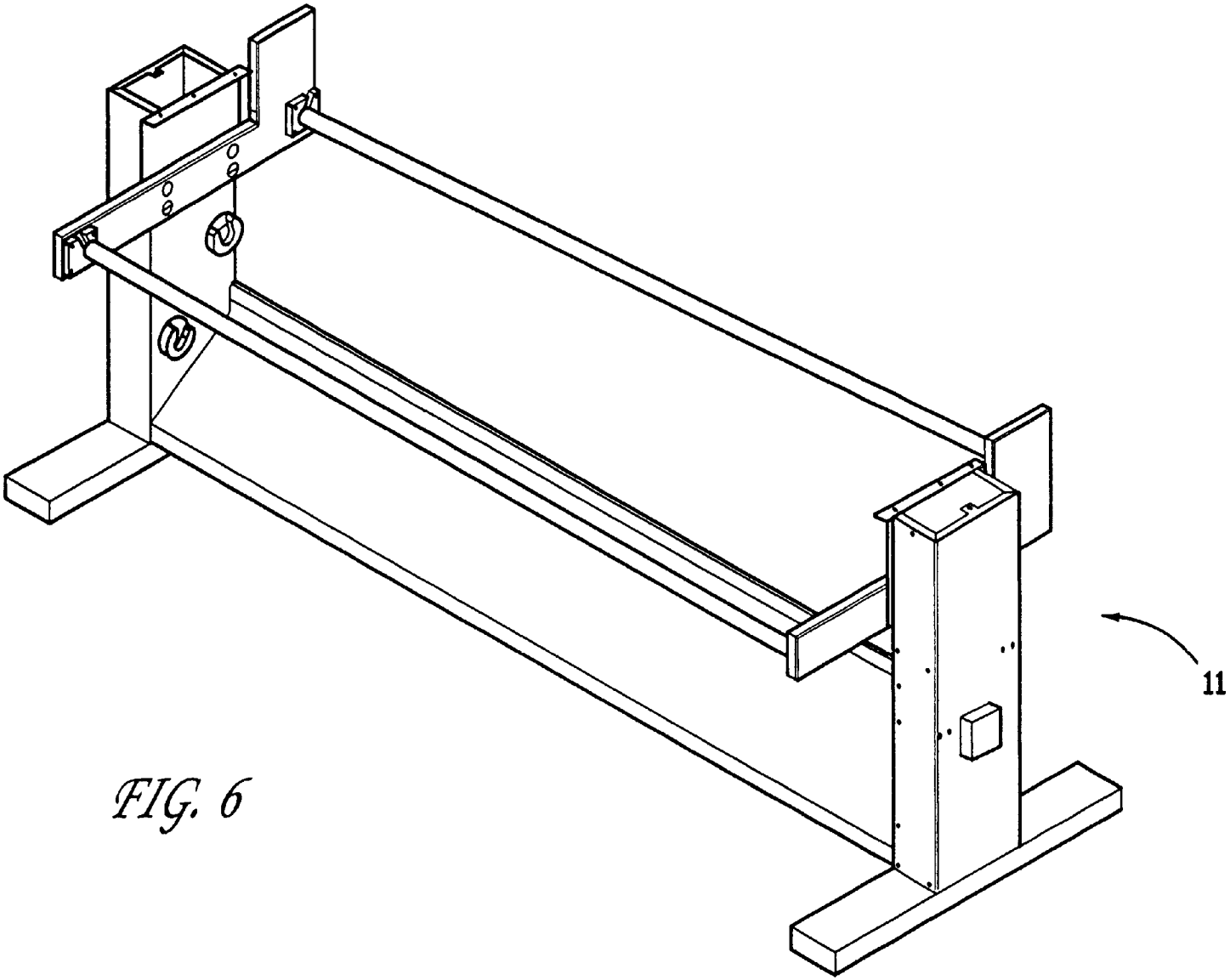
FIG. 6 is a perspective view of a frame member usable with the present invention.

FIG. 6 is a perspective view of a frame member 11 usable with the print engine 10 (not shown) of the present invention.

Figure 7:
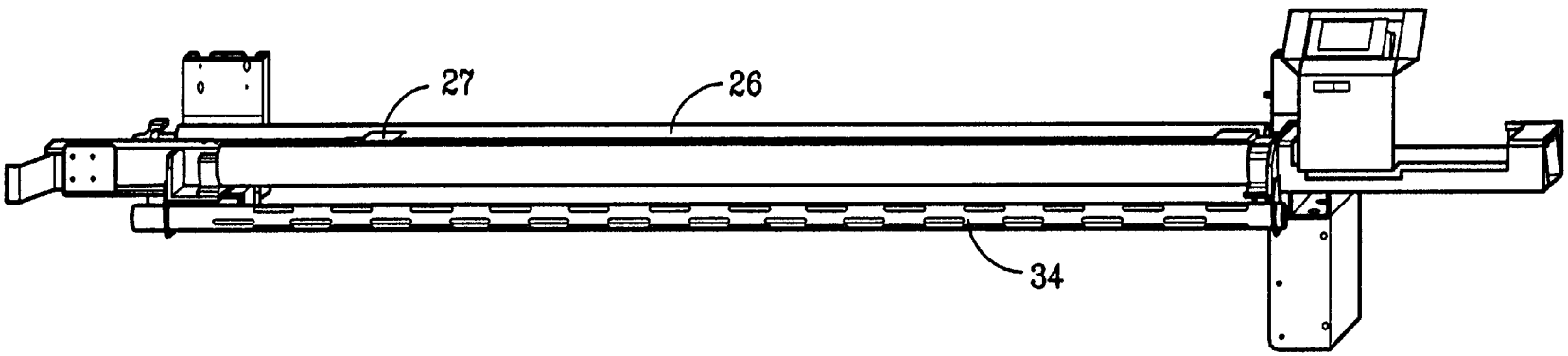
FIG. 7 is a perspective view from slightly above the plane of elevation of the print zone of the present invention and depicting the adjustable salvage edge member set at approximately the same height as the full web roller members over the "open web" print zone of preferred embodiments of the present invention.

FIG. 7 is a perspective view from slightly above the plane of elevation of the print zone of the present invention and depicting the adjustable salvage edge member 27 set at approximately the same height as the full web roller members 30,32 over the "open web" print zone of preferred embodiments of the print engine 10 of the present invention.

Figure 8:
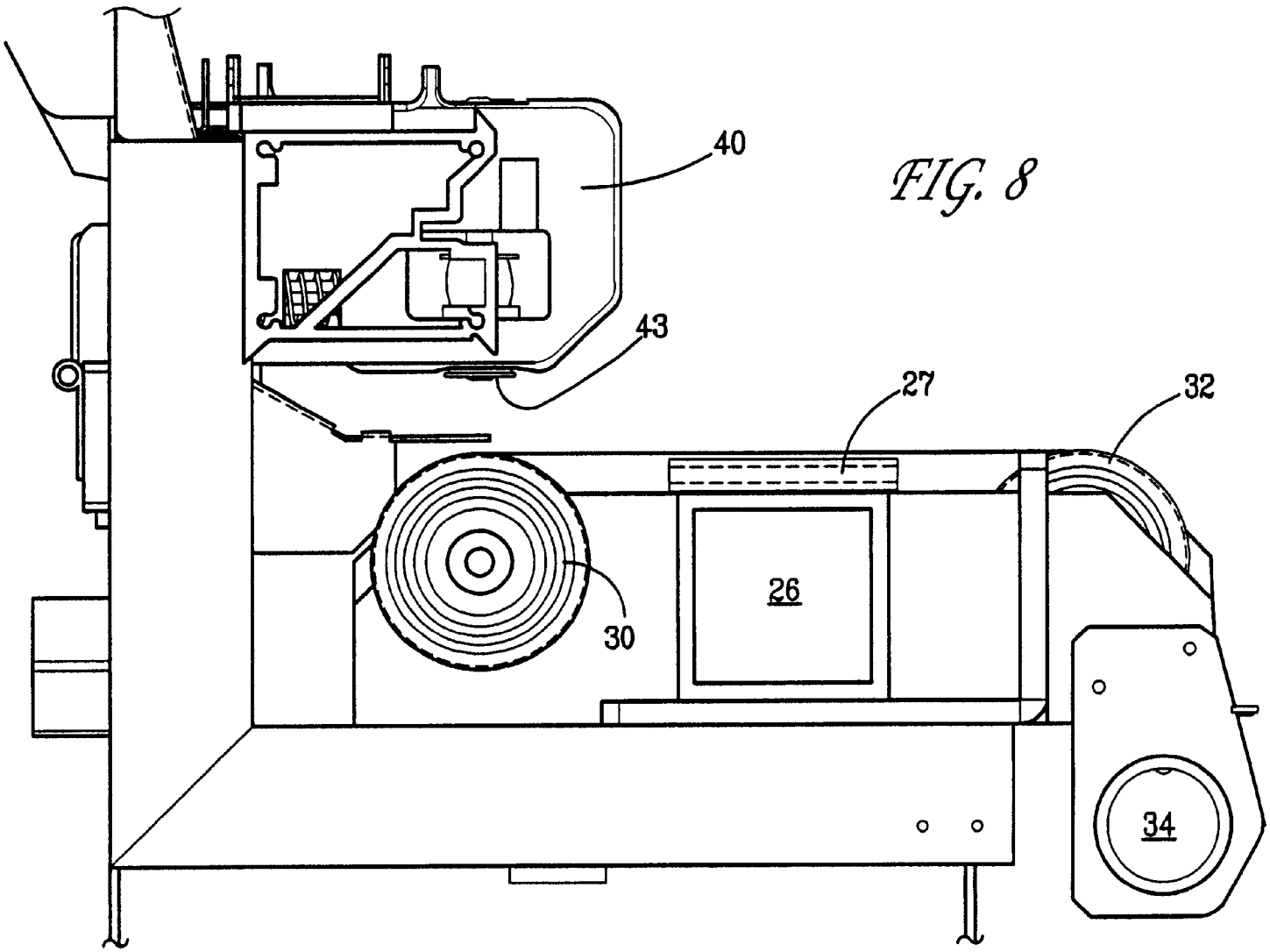
FIG. 8 is an elevational side view depicting the open web print zone of the present invention.

FIG. 8 is an elevational side view depicting the open web print zone of the present invention.

Figure 9:
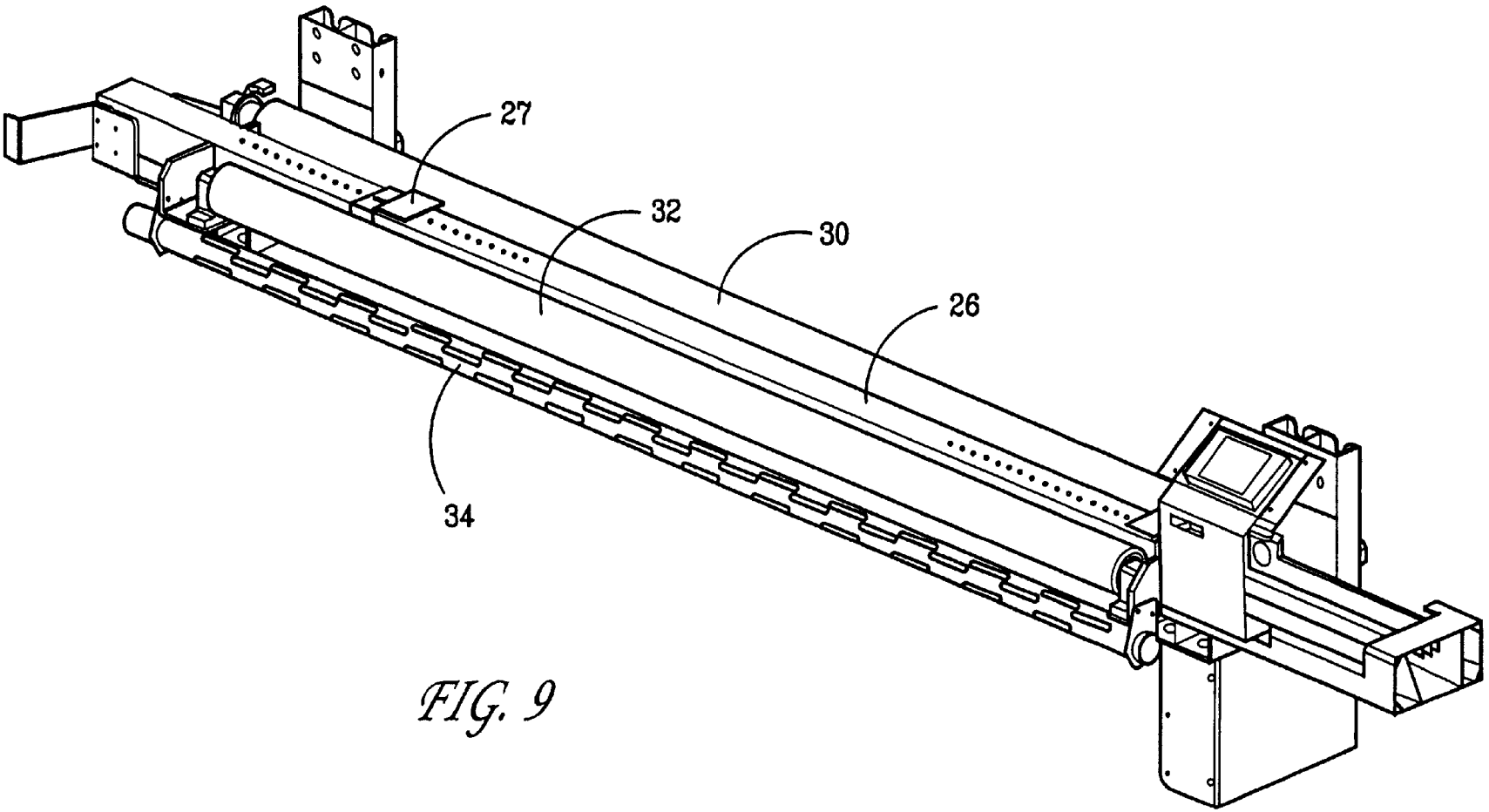
FIG. 9 is a perspective view similar to FIG. 4 but additionally depicting an upper rail member which supports a flexible chain member which in turn retains ink tubing and electrical conduit and which couples the print engine electronics to the print cartridges disposed in the reciprocating carriage assembly (not shown in FIG. 5).

FIG. 9 is a perspective view similar to FIG. 4 but additionally depicting an upper rail member which supports a flexible chain member which in turn retains ink tubing and electrical conduit and which couples the print engine electronics to the print cartridges disposed in the reciprocating carriage assembly (not shown in FIG. 5).

Figure 10B:
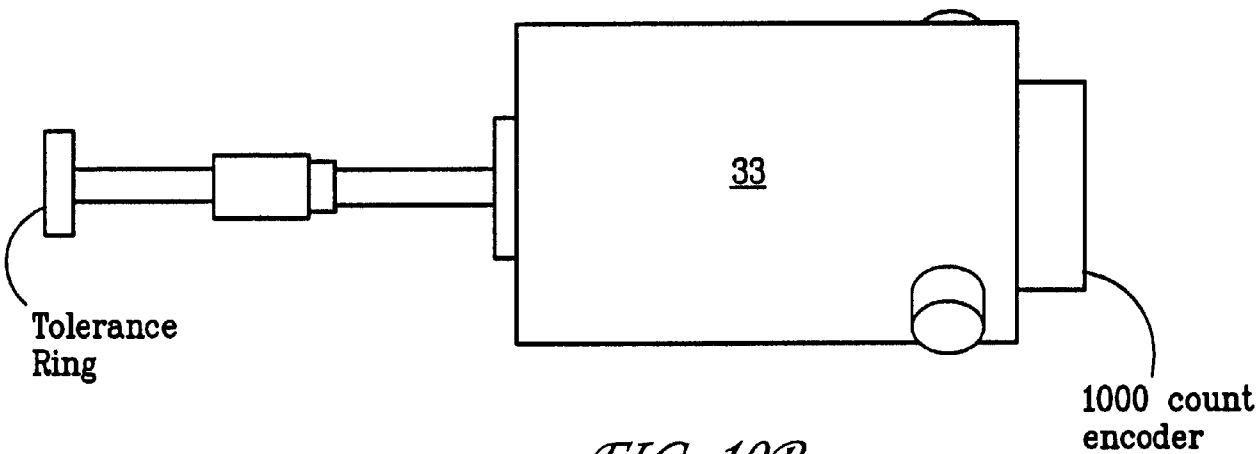
FIGS. 10A and 10B are two views of a media drive motor usable with the present invention coupled to a full-web grit roller member and having a 1000 count rotary encoder directly coupled to the media drive motor for providing an output signal indicative of the position of the motor and thereby a precise measurement of the magnitude of media advance sequences.
Figure 10A:
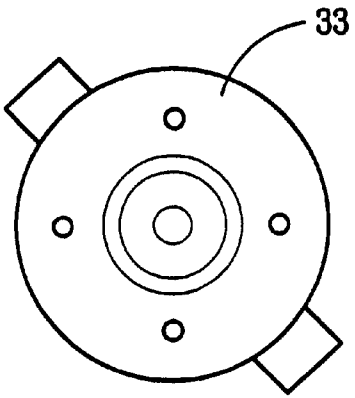
Figure 11B:
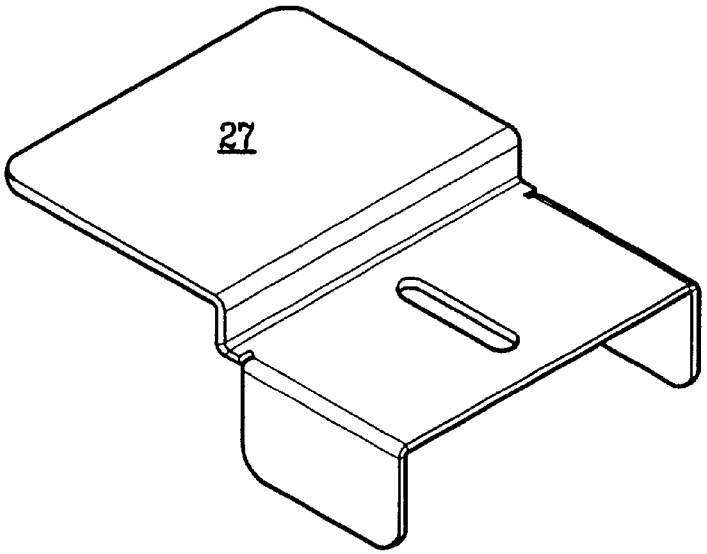
FIGS. 11A, 11B, 11C, and 11D are views of an exemplary salvage edge member usable in conjunction with the present invention.
Figure 11D:
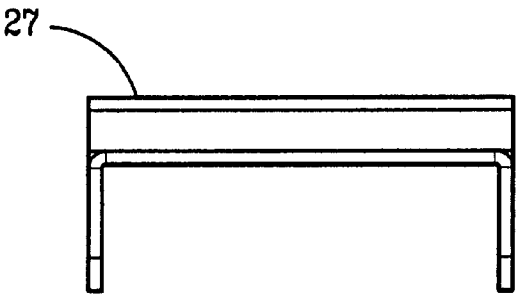
Figure 11A:
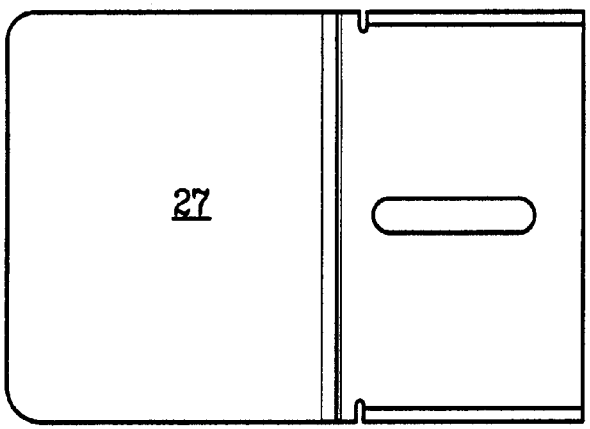
Figure 11C:
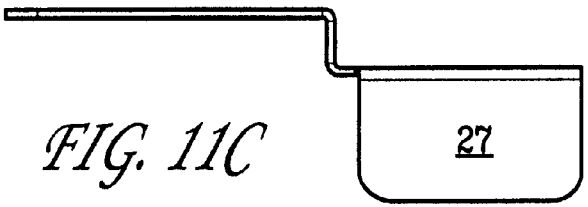
Figure 12B:
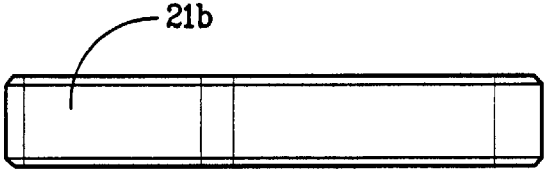
FIGS. 12A, 12B, 12C, 12D, and 12E depict one embodiment of a slotted idler bracket that promoted a "snap fit" to an idler roller disposed proximate the powered full-web grit roller of the present invention.
Figure 12C:
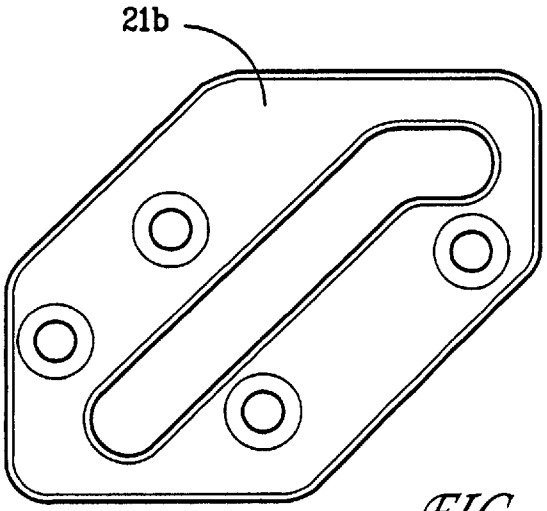
Figure 12E:
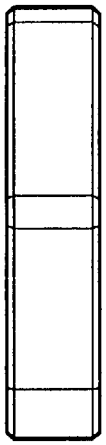
Figure 12A:
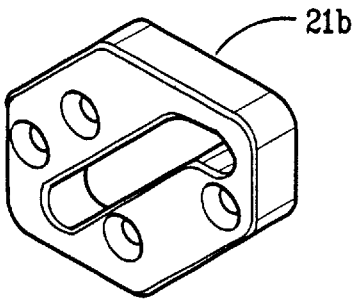
Figure 12D:
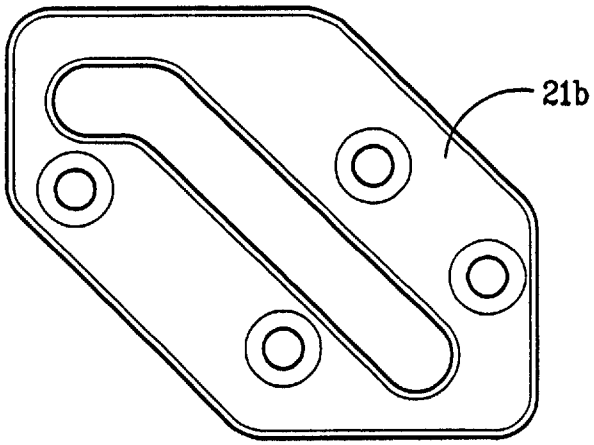

FIGS. 10A and 10B are two views of a media drive motor 33 usable with the print engine 10 of the present invention coupled to the full-web grit roller member 30 and preferably having a 1,000 count rotary encoder directly coupled to the media drive motor 33 for providing an output signal indicative of the position of the motor and thereby a precise measurement of the magnitude of media advance sequences which is preferably conveyed to print engine electronic control circuitry (not shown).

FIGS. 11A, 11B, 11C, and 11D are views of an exemplary salvage edge member 27 usable in conjunction with the print engine 10 of the present invention.

FIGS. 12A, 12B, 12C, 12D, and 12E depict one potential embodiment of a slotted idler bracket that promoted a "snap fit" to an idler roller 21 disposed proximate the powered full-web grit roller 30 of the present invention. The snap fit occurs when the media is attached to both the supply roller 12 and take up roller 14 and any slack is removed from the print media web thereby imparting a force to the roller 21 that urges an end peg 21*a* of the roller 21 (depicted in FIG. 14) slide forward in positive engagement with an angled portion of the slotted bracket 21*b* which receives roller 21.

Figure 13B:
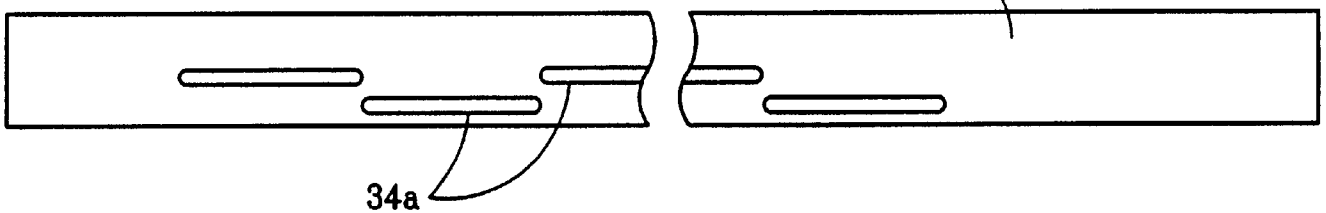
FIGS. 13A, 13B, and 13C depict views of an exemplary underside media drying plennum member having an overlapping set of fluid exit apertures that is usable in conjunction with the present invention.
Figure 13A:
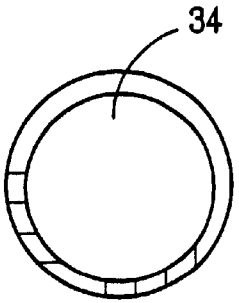
Figure 13C:
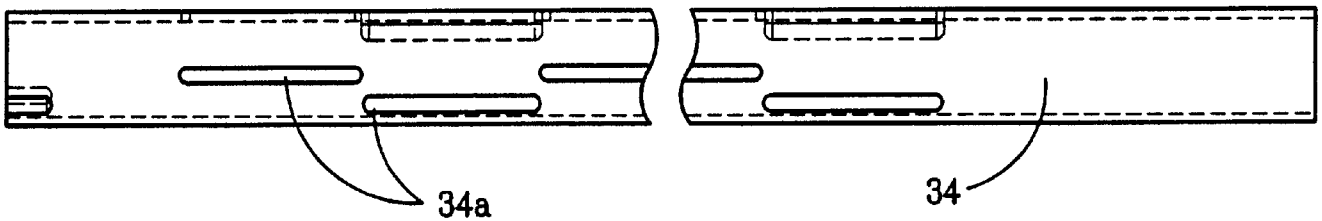

FIGS. 13A, 13B, and 13C depict views of an exemplary underside media drying plenum member 34 having an overlapping set of fluid exit apertures 34*a* that is usable in conjunction with the present invention.

Figure 14A:
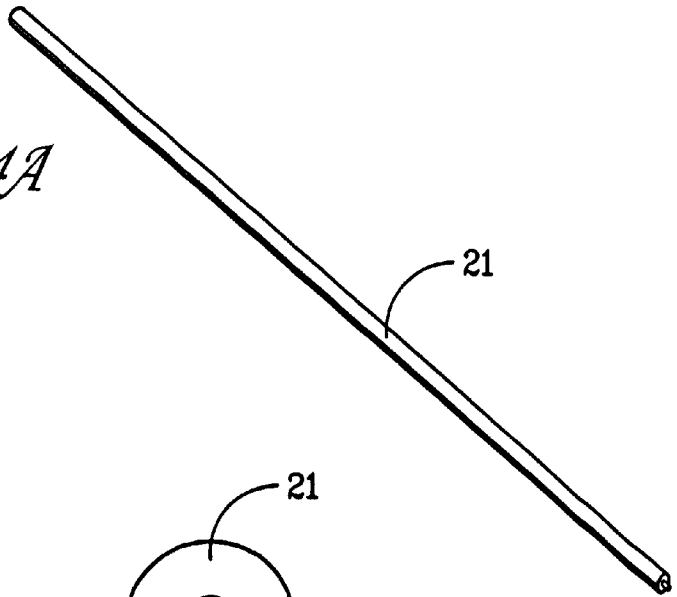
FIGS. 14A, 14B, and 14C depict an idler roller having pegs formed at each end thereof for engaging corresponding structure on the print engine frame.
Figure 14C:
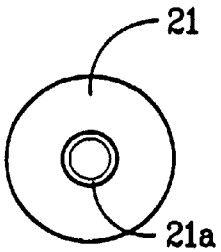
Figure 14B:
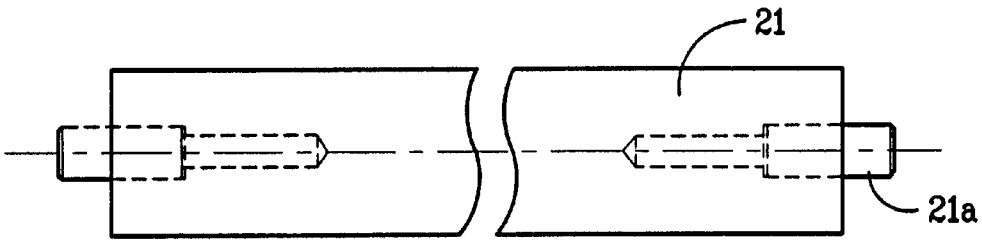

FIGS. 14A, 14B, and 14C depict an idler roller 21 having pegs 21 a formed at each end thereof for engaging corresponding structure 21*b* (see FIG. 3) on the print engine frame 11.

Figure 15:
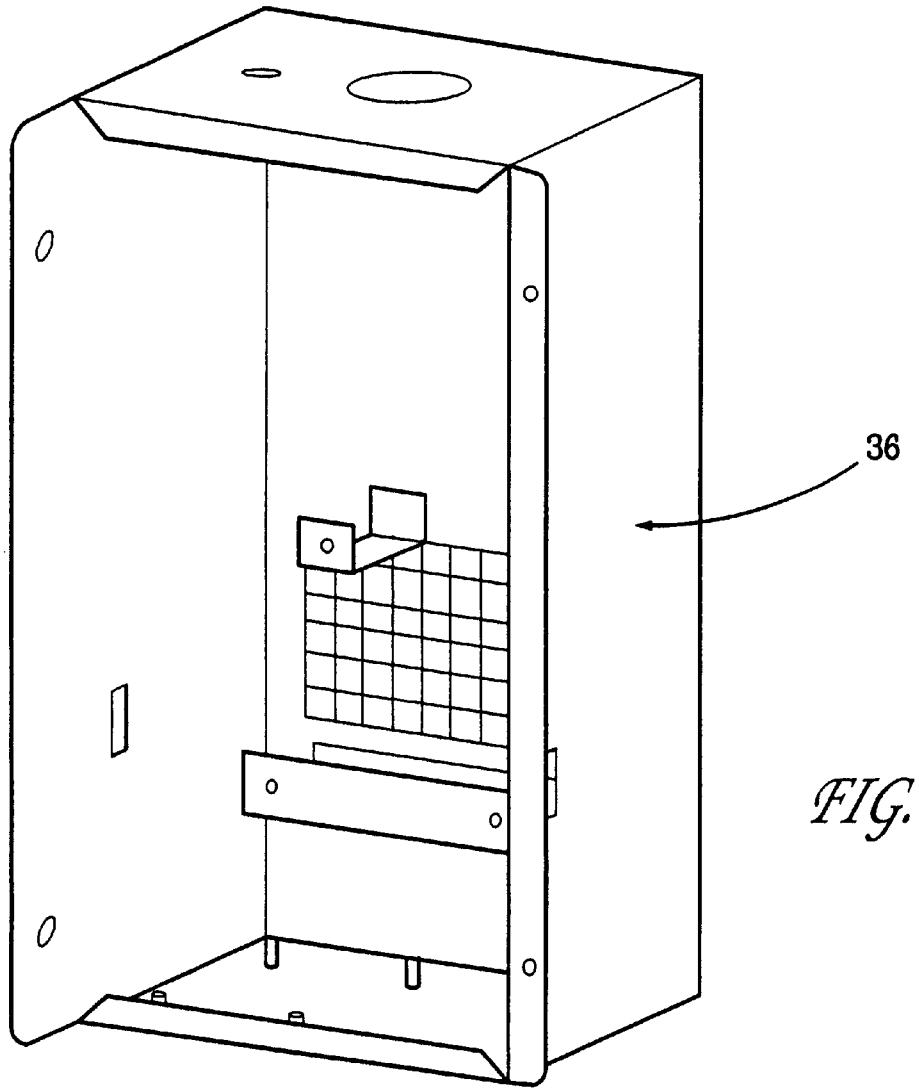
FIG. 15 is a perspective view of an enclosure for safely retaining a blower fan and heated coil assembly for producing the heated, forced air drying effects on the upper and underside of freshly printed media; said enclosure is preferably mounted to the frame member of the ink jet print engine.

FIG. 15 is a perspective view of an enclosure for safely retaining a blower fan and heated coil assembly 36 for producing the heated, forced air drying effects on the upperside (via upper heater 44) and underside (via lower heater 34) of freshly printed media; said enclosure is preferably mounted to the frame member 11 of the ink jet print engine 10.

Figure 16:
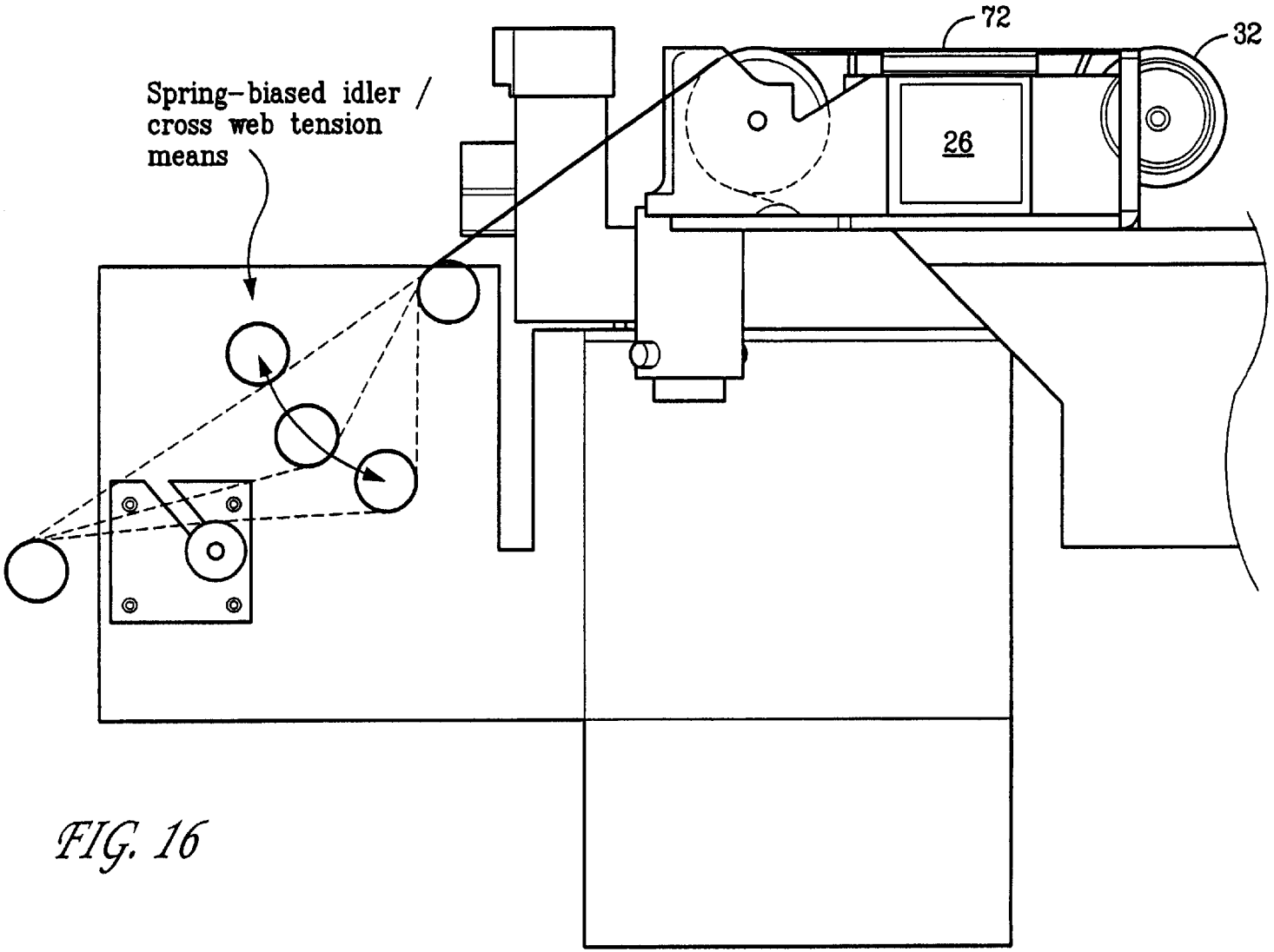
FIG. 16 is an elevational side view of an embodiment wherein a first one of two powered cross-web rollers is adjustable over a radius (shown in ghost in FIG. 16) to thereby vary the amount of "bite" of the combined set of rollers when each is equipped with coils of cord-like material, wound in opposing directions from near a center point of said print media to thereby impart cross web tension in the print media.

FIG. 16 is an elevational side view of an embodiment wherein a first one of two powered cross-web rollers 50,52 is adjustable over a radius (shown in ghost in FIG. 16) to thereby vary the amount of "bite" of the combined set of rollers 50,52 when each is equipped with coils of cord-like material, wound in opposing directions from near a center point of said print media to thereby impart cross web tension in the print media. In FIG. 16, a not optional print media path that bypasses the idler roller 21 is depicted but has proven less than useful when cross-web tension in the print media is necessary or desired. Also depicted in FIG. 16 is an optional material pad 72 which can be attached to the platen frame member 26 to reduce the amplitude of wrinkles in the print media while at the same time absorbing any marking material that travels through a selected print media. In the later case, the pad 72 is preferably a replaceable and disposable part and can be attached with a variety of temporary attachment means as is known and used in the art.

Figure 17B:
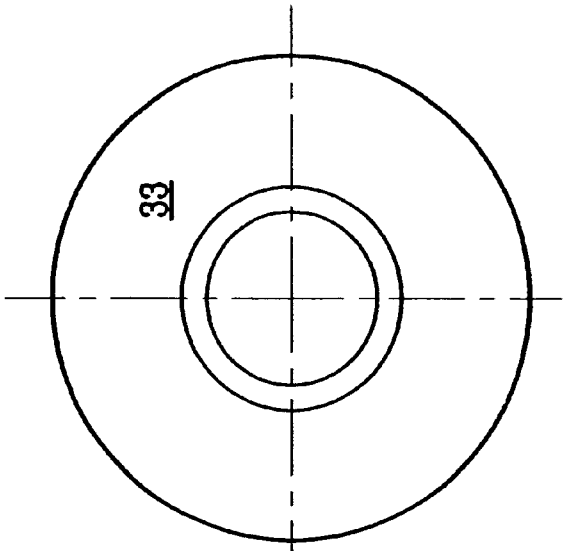
FIG. 17B is a cross-sectional view of a portion thereof.
Figure 17A:
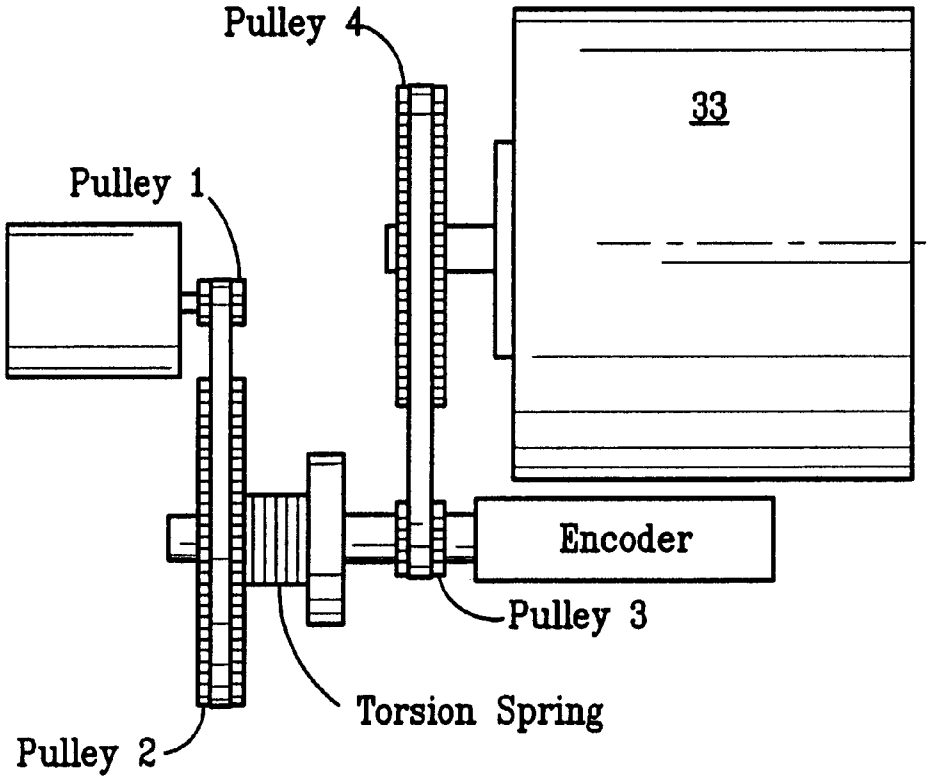
FIG. 17A is a plan view of a low torque electric motor designed to constantly produce comprising axial forces (parallel in direction to the media advance direction) in the print media.

FIG. 17A is a plan view of a low torque electric motor 33 designed to constantly produce opposing axial forces (parallel in direction to the media advance direction) in the print media.

FIG. 17B is a cross-sectional view of a portion thereof.

Figure 18:
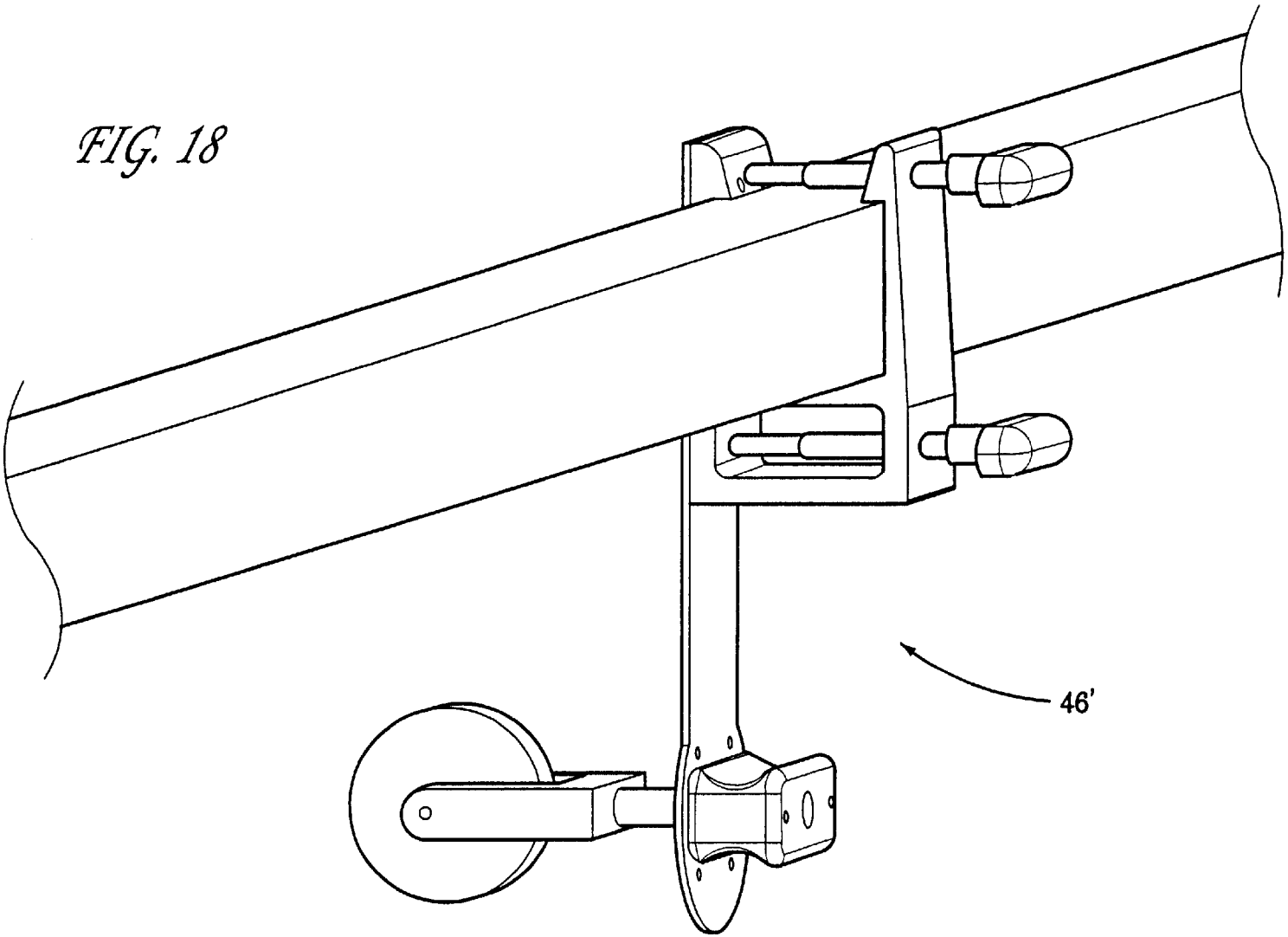
FIG. 18 is a perspective view of a first embodiment for a media edge cross-web tension means.

FIG. 18 is a perspective view of a first embodiment for a media edge cross-web tension means 46'.

Figure 19:
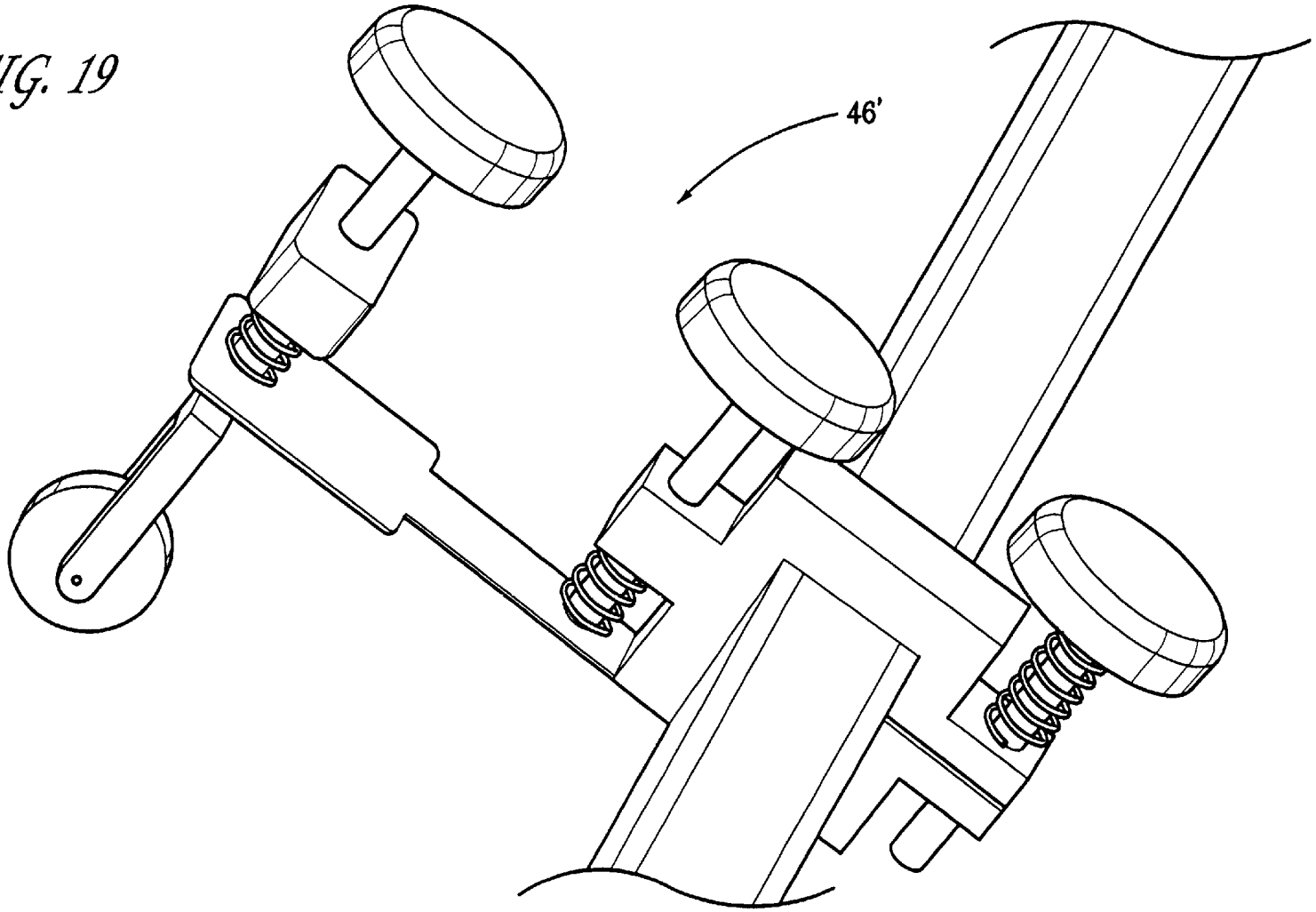
FIG. 19 is a perspective view of the media edge cross-web tension means depicted in FIG. 18.

FIG. 19 is a perspective view of the media edge cross-web tension means 46' depicted in FIG. 18.

Figure 20:
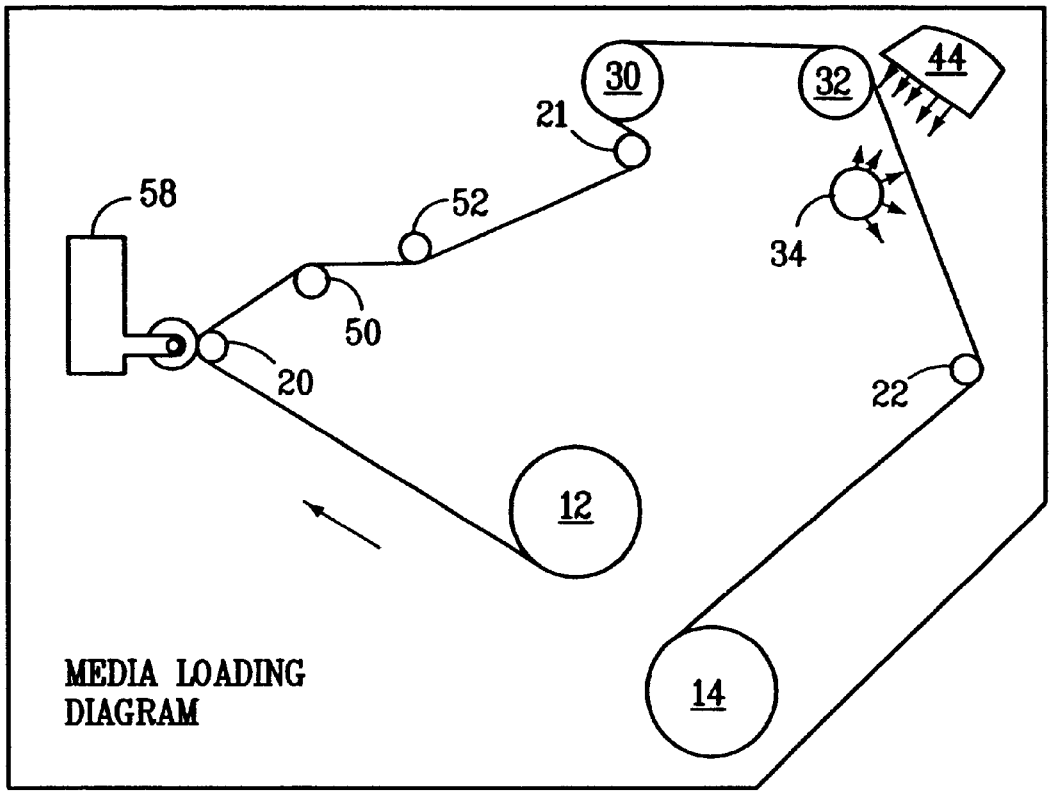
FIG. 20 is a diagram depicting a preferred pathway for a print media traversing from a supply roll to an idler roller with an edge wheel and then through a pair of cross-web tensioning means to another idler roller, and then to a powered full-web grit roller through an "open web" printing zone, over a second full-web roller, through a dual side forced air drying region, over a final idler roller, before being collected on the take-up roller.

FIG. 20 is a diagram depicting a preferred pathway for a print media traversing from a supply roll 12 to an idler roller 20 with a radially adjustable edge wheel (not shown) and then through a pair of cross-web tensioning means 50, 52 to another idler roller 21, and then to a powered full-web grit roller 30 through an "open web" printing zone, over a second full-web roller 32, through a dual side forced air drying region 34/44,over a final idler roller 22, before being collected on the take-up roller 14.

Figure 21:
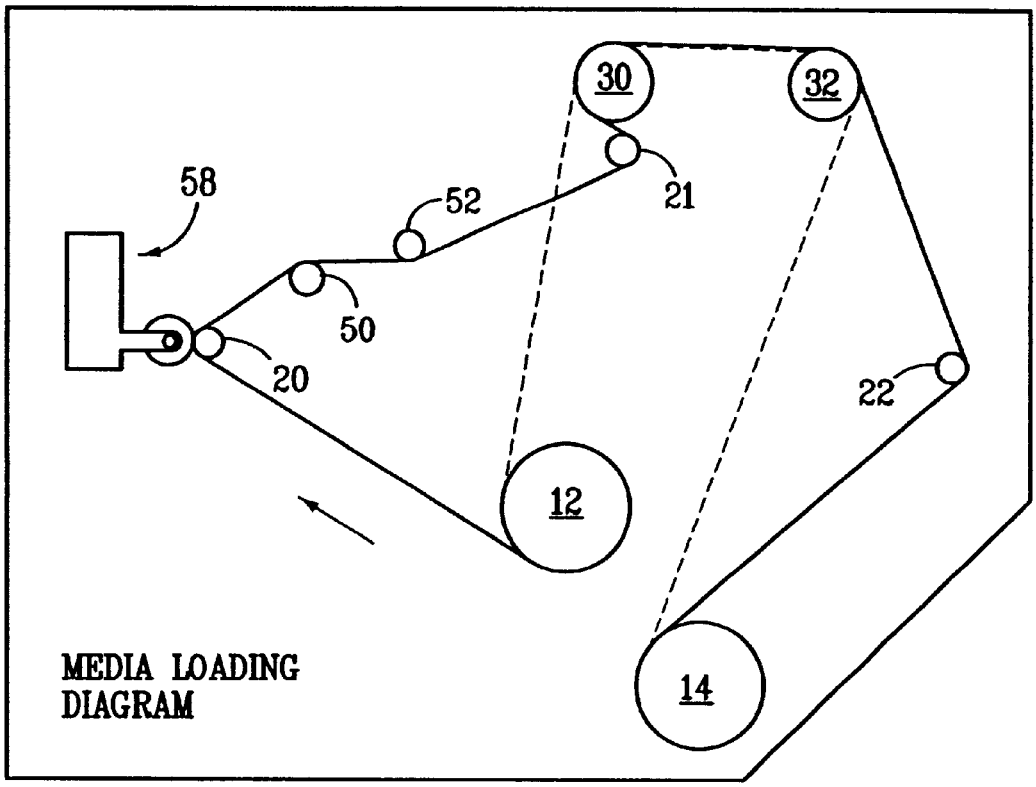
FIG. 21 is similar to FIG. 20 but shows slightly less detail than FIG. 20 to better illustrate the fact that the print media may travel directly from the supply to the fill-web powered grit roller either directly (in ghost) or via an intermediate idler roller disposed proximate the full-web grit roller for types of print media that will not appreciably benefit from the cross-web tensioning means depicted herein (e.g., for "standard" coated ink jet print media).

FIG. 21 is similar to FIG. 20 but shows slightly less detail than FIG. 20 to better illustrate the fact that the print media may travel directly from the supply to the full-web powered grit roller 30 either directly (in ghost) or via an intermediate idler roller 21 disposed proximate the full-web grit roller 30 for types of print media that will not appreciably benefit from the cross-web tensioning means depicted herein (e.g., for "standard" coated ink jet print media and the like).

Figure 22:
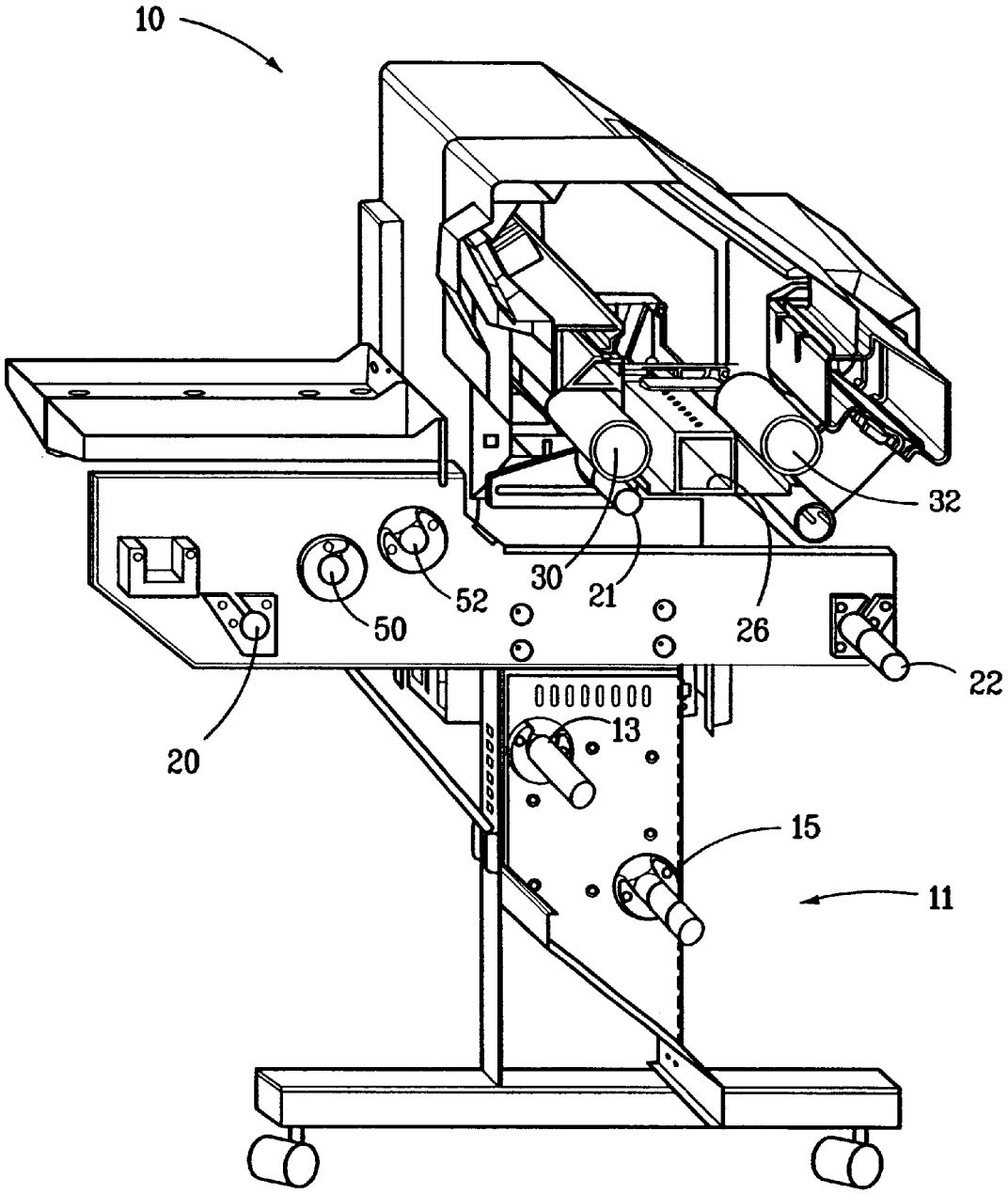
FIG. 22 is a perspective view in partial cross section depicting the various assemblies and surfaces that interact with the print media in a large format digital print engine constructed in accordance with the present invention.

FIG. 22 is a perspective view in partial cross section depicting the various assemblies and surfaces that interact with print media in a large format digital print engine 10 constructed in accordance with the present invention to help the reader gain a better appreciation for the juxtaposition of the various elements of the inventive print engine 10 taught herein. Including frame 11, and the supply roller (12) which engages drive bracket 13 and take up roller (14) which engages drive bracket 15. Both drive bracket 13 and 15 are coupled to low torque servo-type motors which provide opposing forces in the web advancement direction.

The technique for maintaining and periodically releasing spring tension from each low torque motor proceeds as follows. A spring member having a spring constant designed to withstand anticipated diameter of supply media roll on the order of approximately six inches (6") and the anticipated inertial forces to overcome to begin advancing the media is coupled to the shaft of the low torque motor. In one embodiment, a pair of opposing peg members are coupled to the spring and the motor housing, respectively, which ensures that any recoil of the spring, typically produced following a hard stop or immediate power off situation is stopped. The opposing peg approach limits the spring compensation mechanism to less than one hundred eighty degrees of rotation. Furthermore, as larger springs are utilized the peg members sometime experience sudden failure following an uncontrolled unwinding of the spring when the electric motor loses power. Thus, a second embodiment for assisting the low torque motors while preserving maximum flexibility regarding the number of turns the spring can achieve to reduce any inadvertent or undesired loading of the spring member. The approach basically assumes that the spring force vary as a square of the number of rotations of the spring and that the useful range of motion of a given spring that is operating within a desired range of operation is approximately fifty degrees of rotation. Thus, the technique of the second embodiment simply backs up the motor approximately between twenty and fifty degrees and assumes that a local minimum or energy well has been reach and the continuous opposing bias forces upon the print media are substantially reduced or eliminated.

Figure 23:
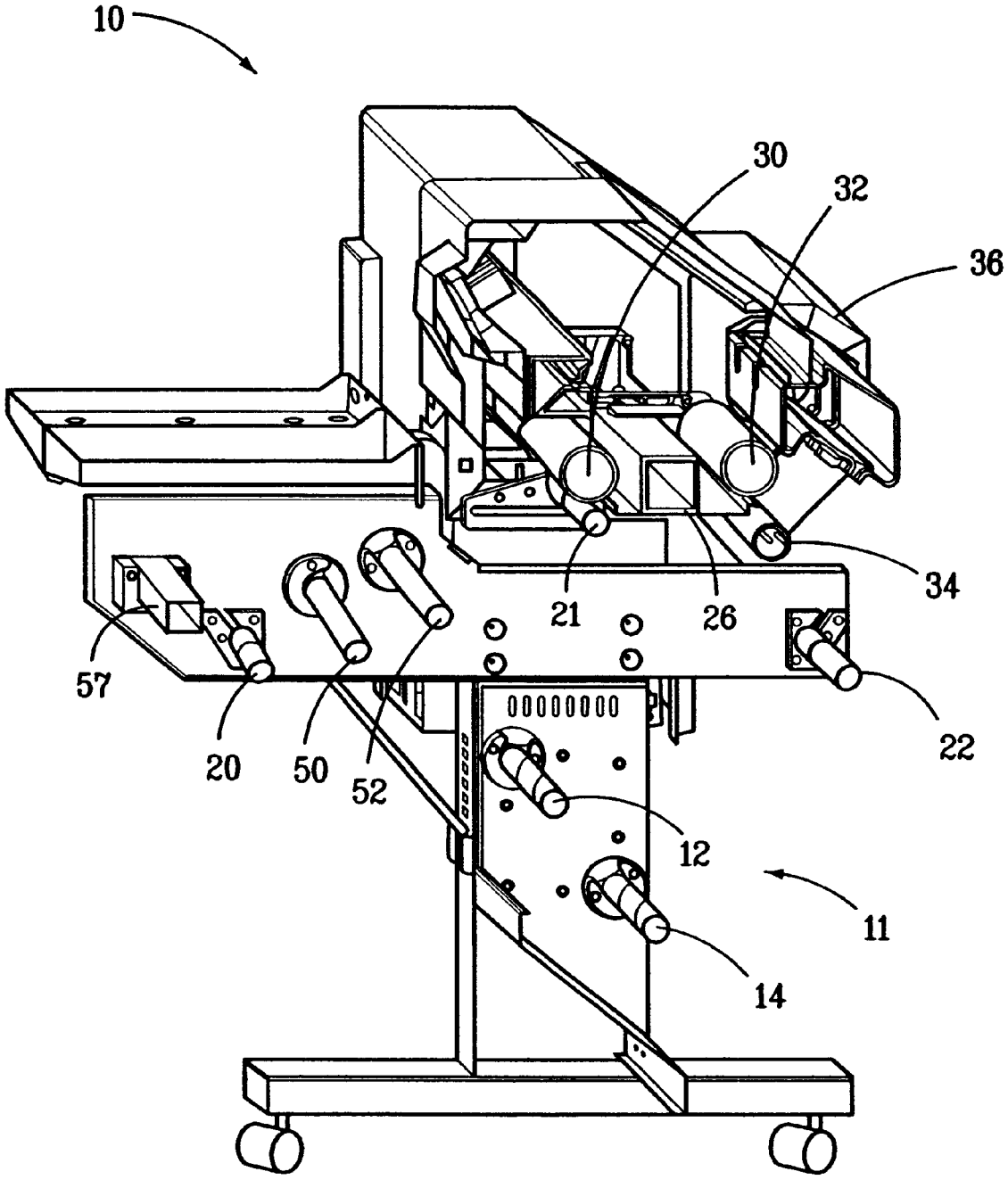
FIG. 23 is a perspective view in partial cross section similar to FIG. 22 but wherein several rollers, assemblies and surfaces that interact with the print media are more fully depicted than in FIG. 22.

FIG. 23 is a perspective view in partial cross section similar to FIG. 22 but wherein several rollers, assemblies and surfaces that interact with the print media are more fully depicted than in FIG. 22.

Figure 24:
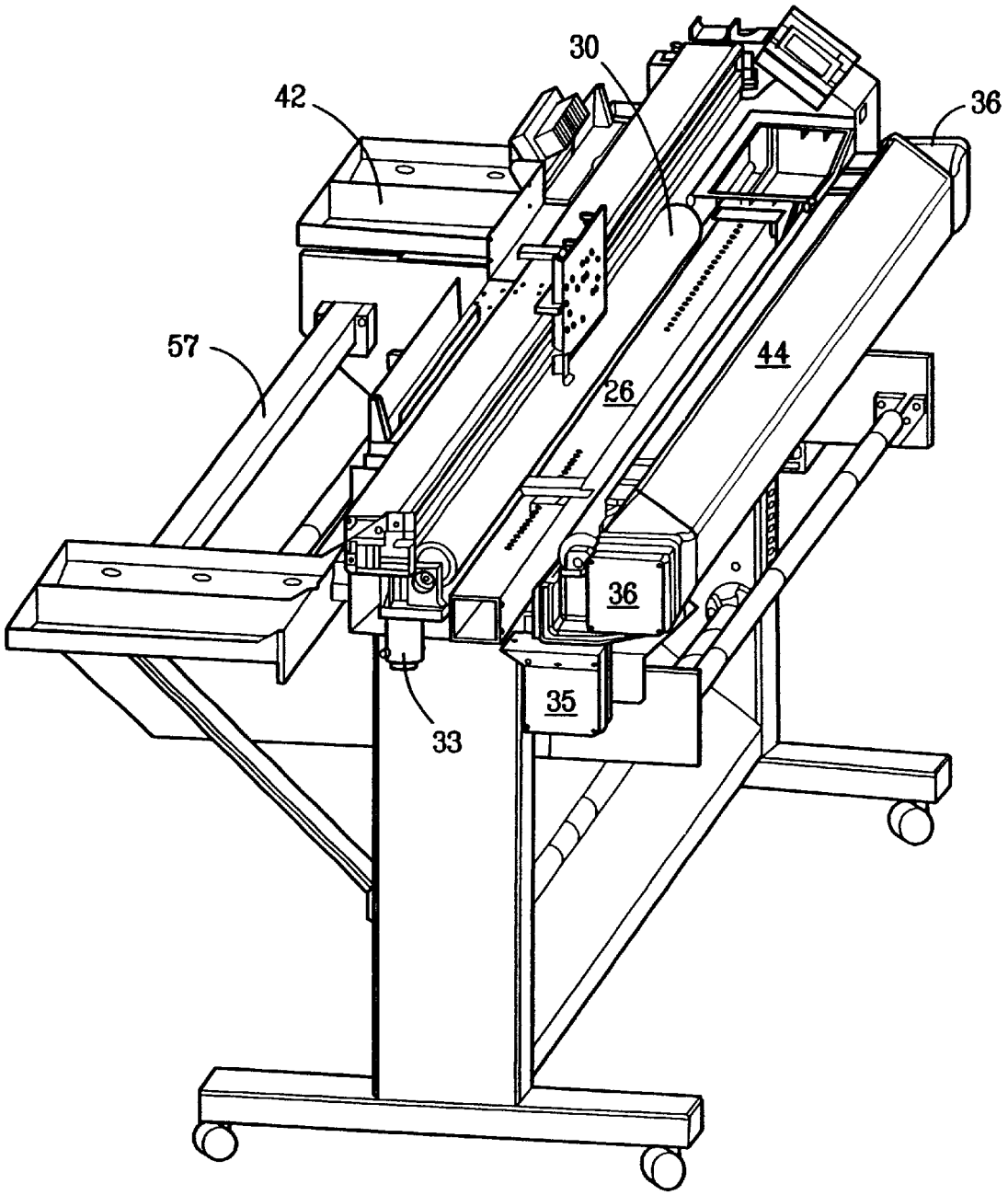
FIG. 24 is a perspective view of an embodiment of an ink jet print engine designed and constructed in accordance with the teaching of the present invention.

FIG. 24 is a perspective view of an embodiment of an ink jet print engine designed and constructed in accordance with the teaching of the present invention showing the preferred location of the ink reservoir supports for the print engine 10 set up to accommodate the hydrodynamic equilibrium required of certain ink jet cartridges manufactured by Hewlett-Packard Company, of Palo Alto, Calif., among others. The specifics of the hydrodynamic conditions required for successfully emitting substantially all of a volume of ink present in a closed bulk ink delivery system the reader should reference U.S. patents issued to Erickson et al. and covering the Big Ink® delivery system owned by the owner of the present application, ColorSpan Corporation (f/k/a LaserMaster Corporation) of Eden Prairie, Minn. 55344 U.S.A.

Figure 25:
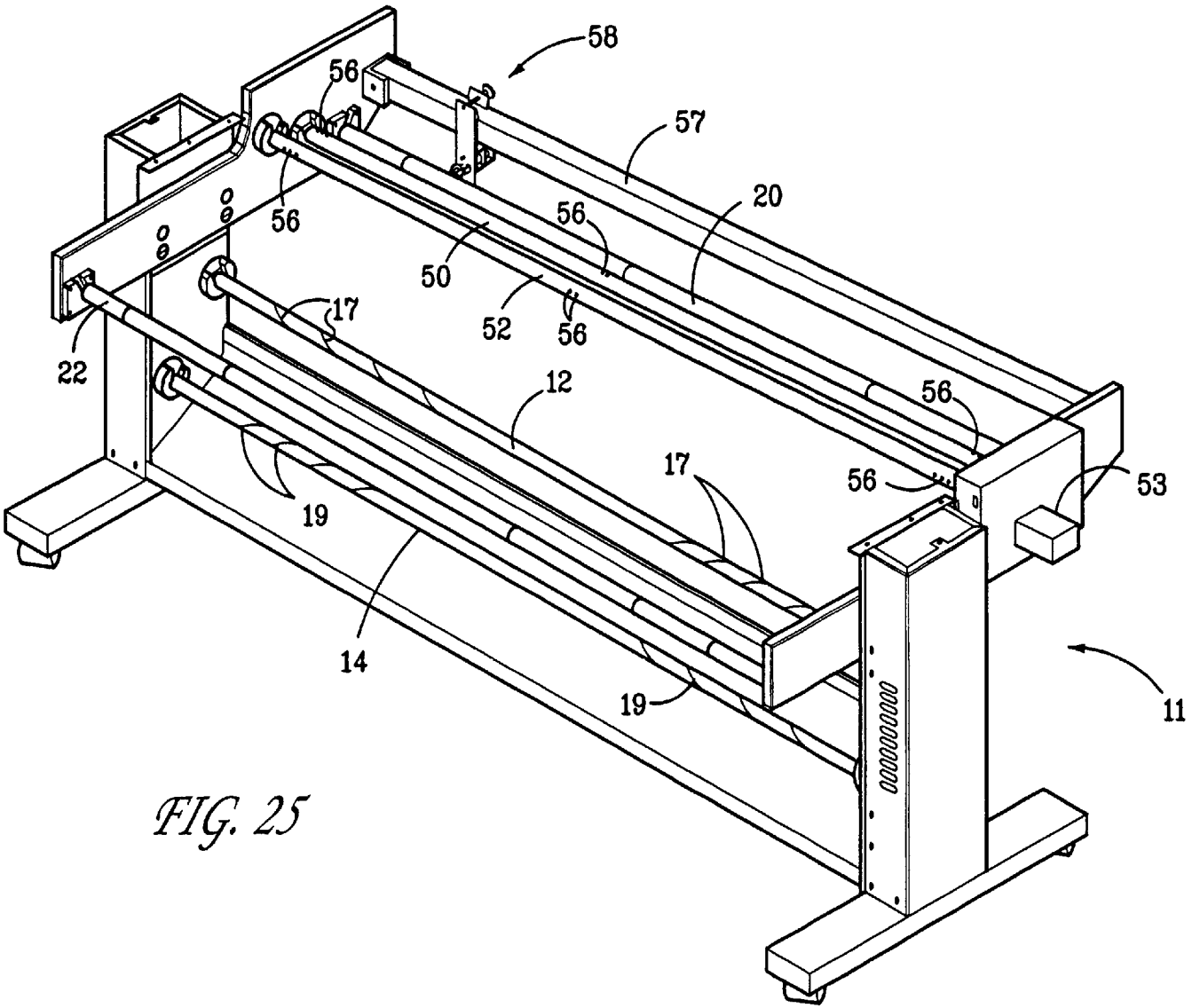
FIG. 25 is a perspective view of a frame member illustrating the manner in which the frame is coupled to the various roller assemblies in accordance with the present invention.

FIG. 25 is a perspective view of a frame member 11 illustrating the manner in which the frame is coupled to the various roller assemblies in accordance with the present invention. In particular, the grooves 17, 19 formed into supply roller 12 and take up roller 14, for example. The ports 56 on powered roller pair 50, 52 for retaining cord material on a case-by-case basis given operating conditions, selected print media, and amount of wrinkles present in a unit of roll-type print media.

Figure 26:
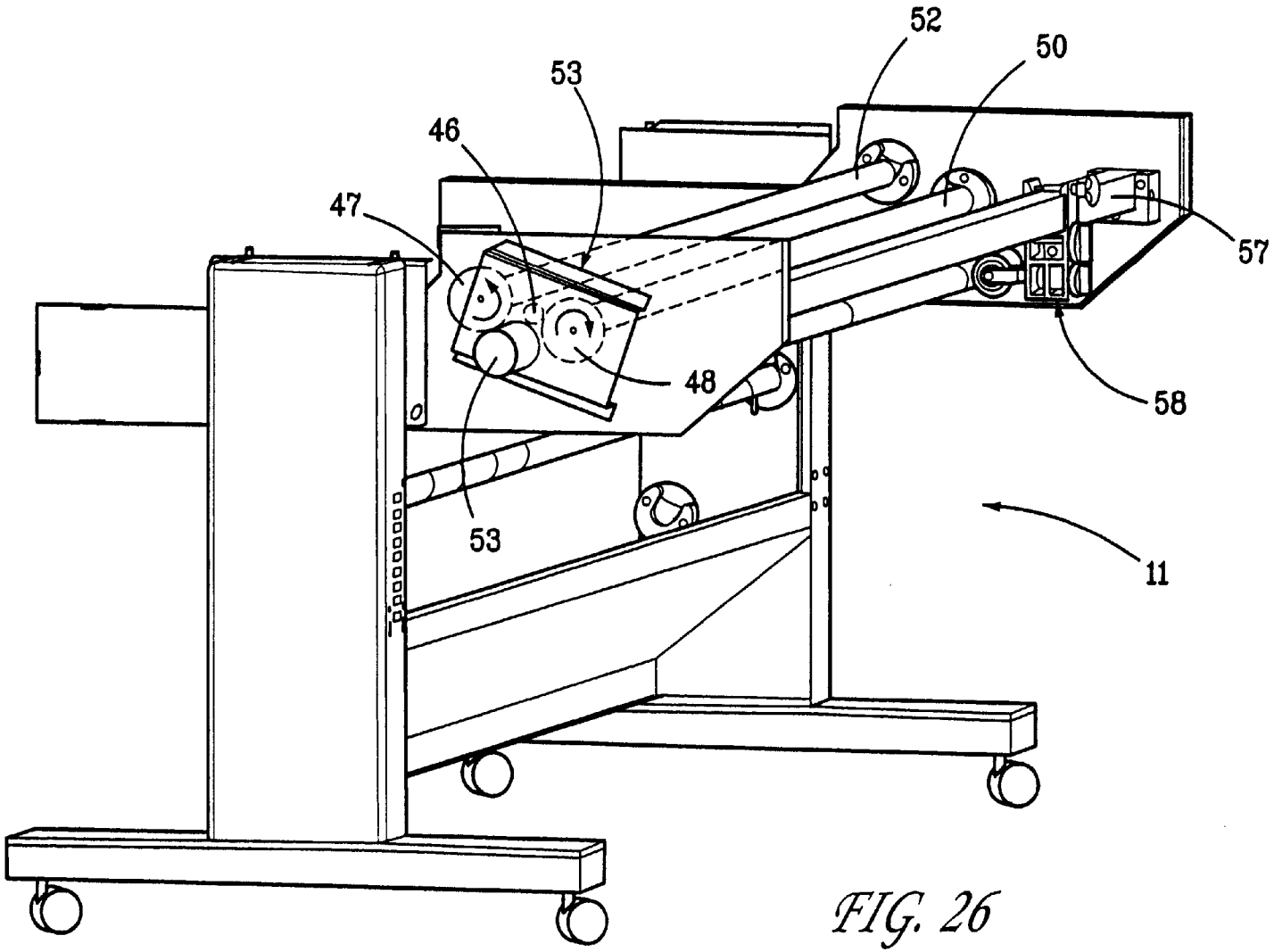
FIG. 26 is a perspective view depicting the motor and gear assembly (in ghost) for driving the pair of powered rollers which have coiled cord material wound thereacross (not depicted) in opposing directions to thereby increase the cross-web tension imparted thereby and also depicting a single wheel-assembly for promoting cross-web tension at the edges of the print media by acting as a directed pinch roller between its wheel member and an adjacent idler roller.

FIG. 26 is a perspective view depicting the electric motor 53 and gear assembly 46,47,48 (in ghost) for driving the pair of powered rollers 50,52 which have coiled cord material wound thereacross (not depicted) in opposing directions to thereby increase the cross-web tension imparted thereby and also depicting a single wheel-assembly 58 for promoting cross-web tension at the edges of the print media by acting somewhat as a "directed pinch" roller upon the media edge portion located between its wheel member 60 and an adjacent idler roller 20.

Figure 27:
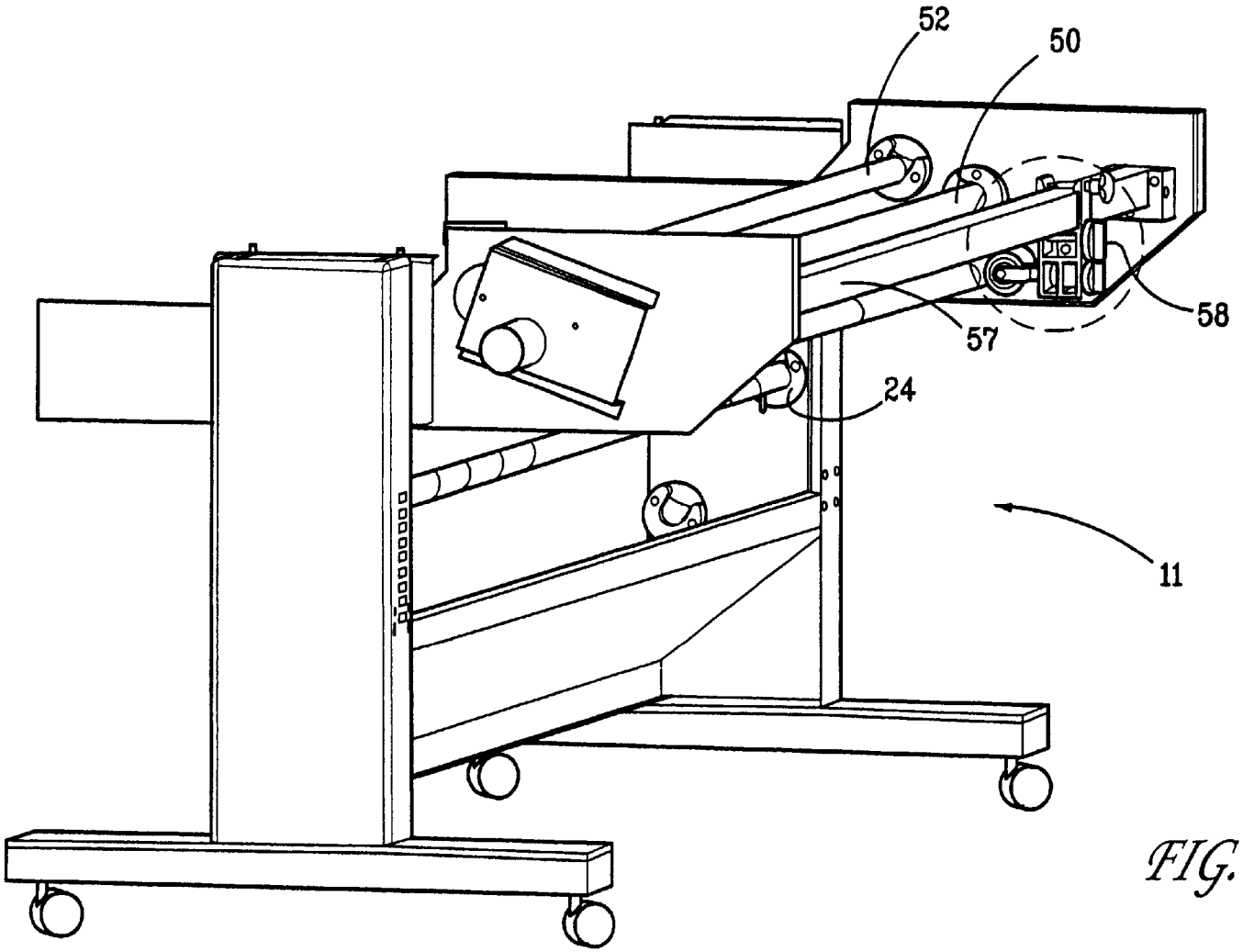
FIG. 27 is a perspective view similar to FIG. 26, but which features the single wheel-assembly for promoting cross-web tension at the edges of the print media by acting as a directed pinch roller between its wheel member and an adjacent idler roller.

FIG. 27 is a perspective view similar to FIG. 26, but which features the single wheel-assembly 58 for promoting cross-web tension at the edges of the print media by acting as a directed pinch roller between its wheel member and an adjacent idler roller 20.

Figure 28:
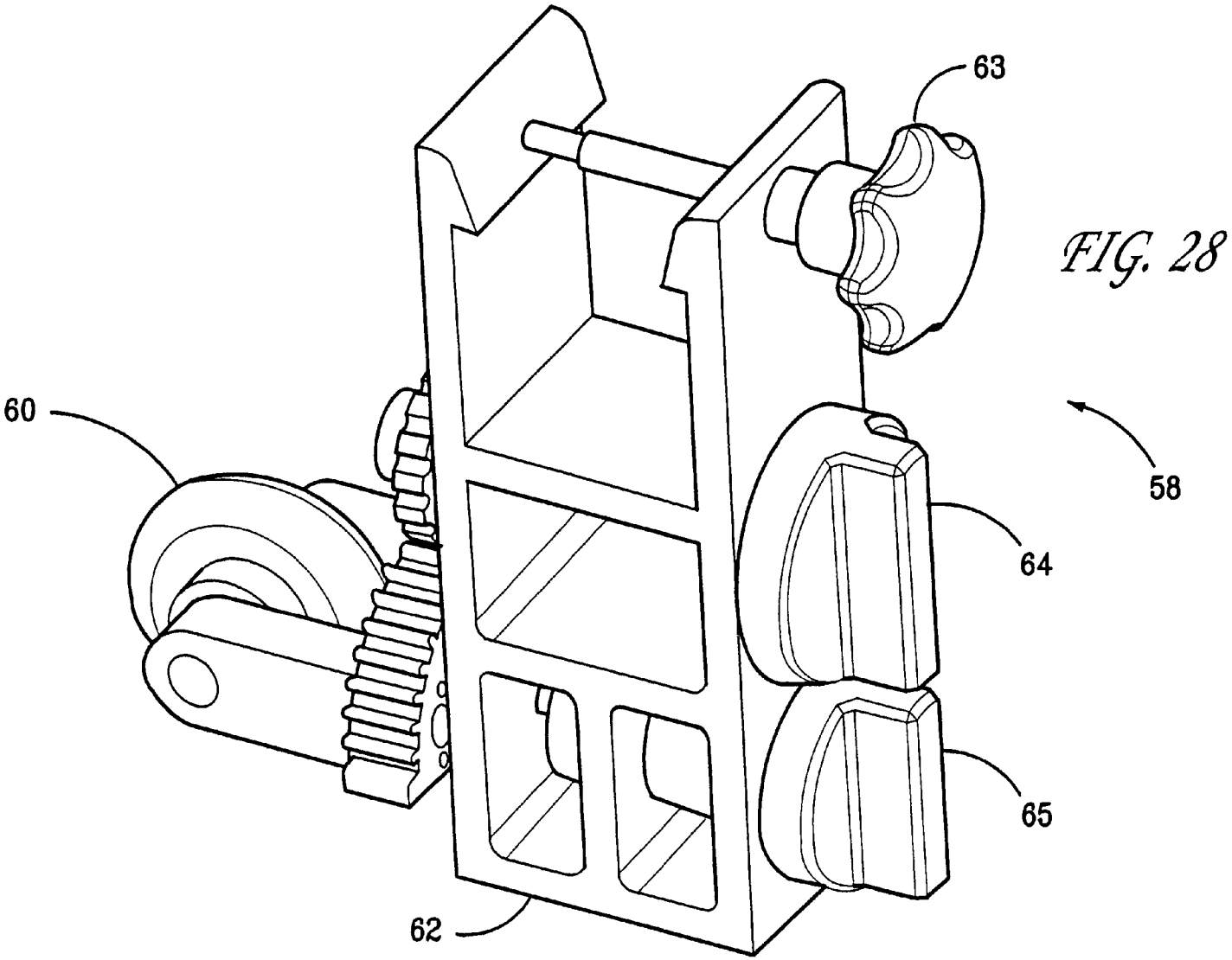
FIG. 28 is a perspective view of the single wheel-assembly for promoting crossweb tension at the edges of the print media by acting as a directed pinch roller between its wheel member and an adjacent idler roller depicted in FIG. 26 and FIG. 27.

FIG. 28 is a perspective view of the single wheel-assembly 58 for promoting cross-web tension at the edges of the print media by acting as a direct pinch roller between its wheel member and an adjacent idler roller depicted in FIG. 26 and FIG. 27. Furthermore, depicted in the FIG. 28 is a tensioning screw 63 for retaining the assembly 58 to the rail 57 (not shown in FIG. 28) and the projection screws 65 which changes the distance wheel 60 projects from the rail 57 to make contact with the idler roller 20 and finally the radial adjustment screw 64 which drives a gear which engages a gear attached near the wheel 60 so that as screw 64 is rotated the angle of attack of the wheel 60 changes relative to a media advance direction.

Figure 29:
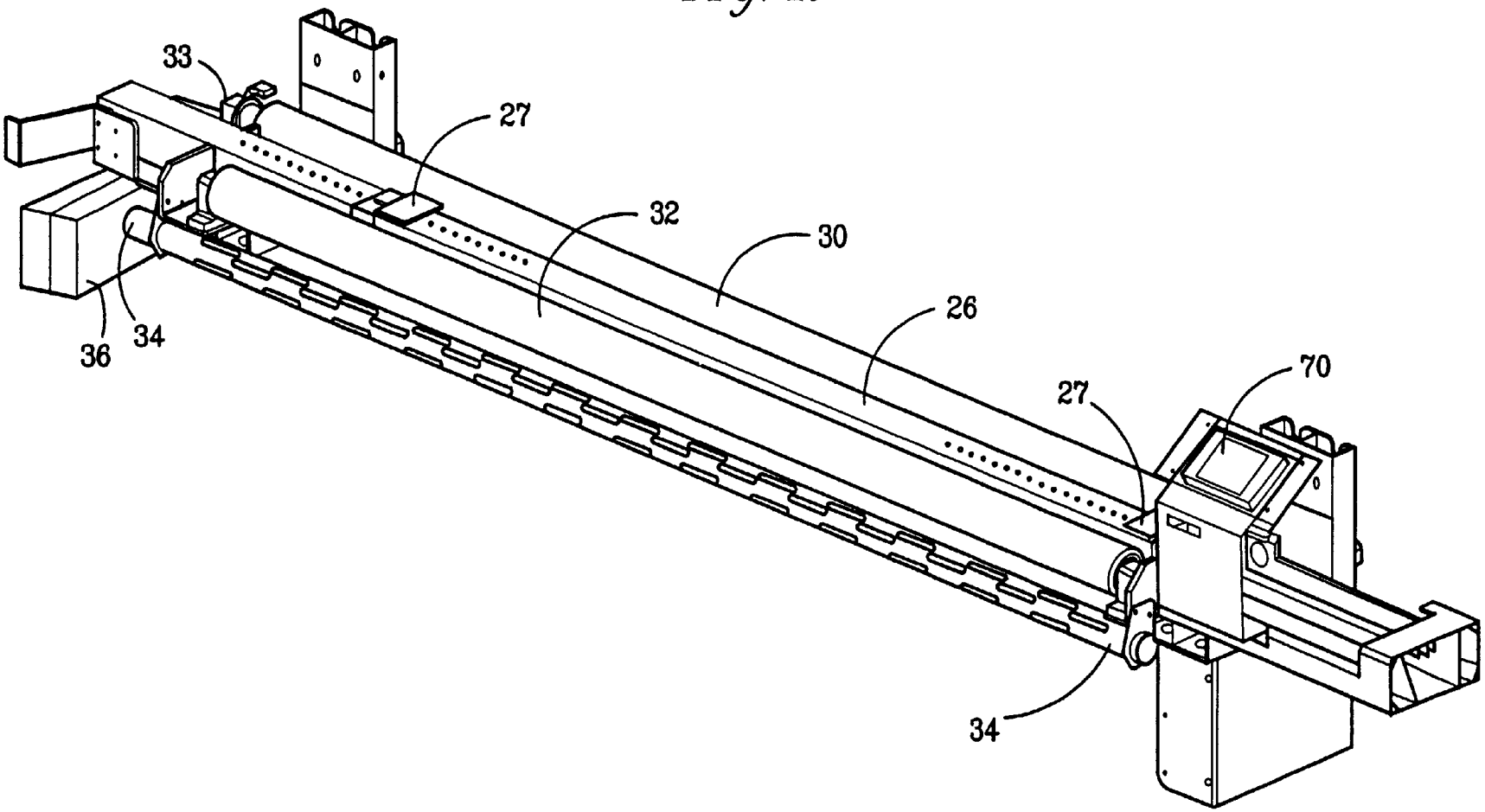
FIG. 29 is a perspective view of the underside dryer apparatus having a single short transition flow piece coupled to a single unit combination forced air blower and heat source for providing a steady stream of heated, forced air to the underside of freshly printed media to drive our moisture and promote rapid drying of the print media.

FIG. 29 is a perspective view of the underside dryer apparatus having a single short transition flow piece coupled to a single unit combination forced air blower and heat source 36 for providing a steady stream of heated, forced air to the underside of freshly printed media to drive our moisture and promote rapid drying of the print media.

Figure 30:
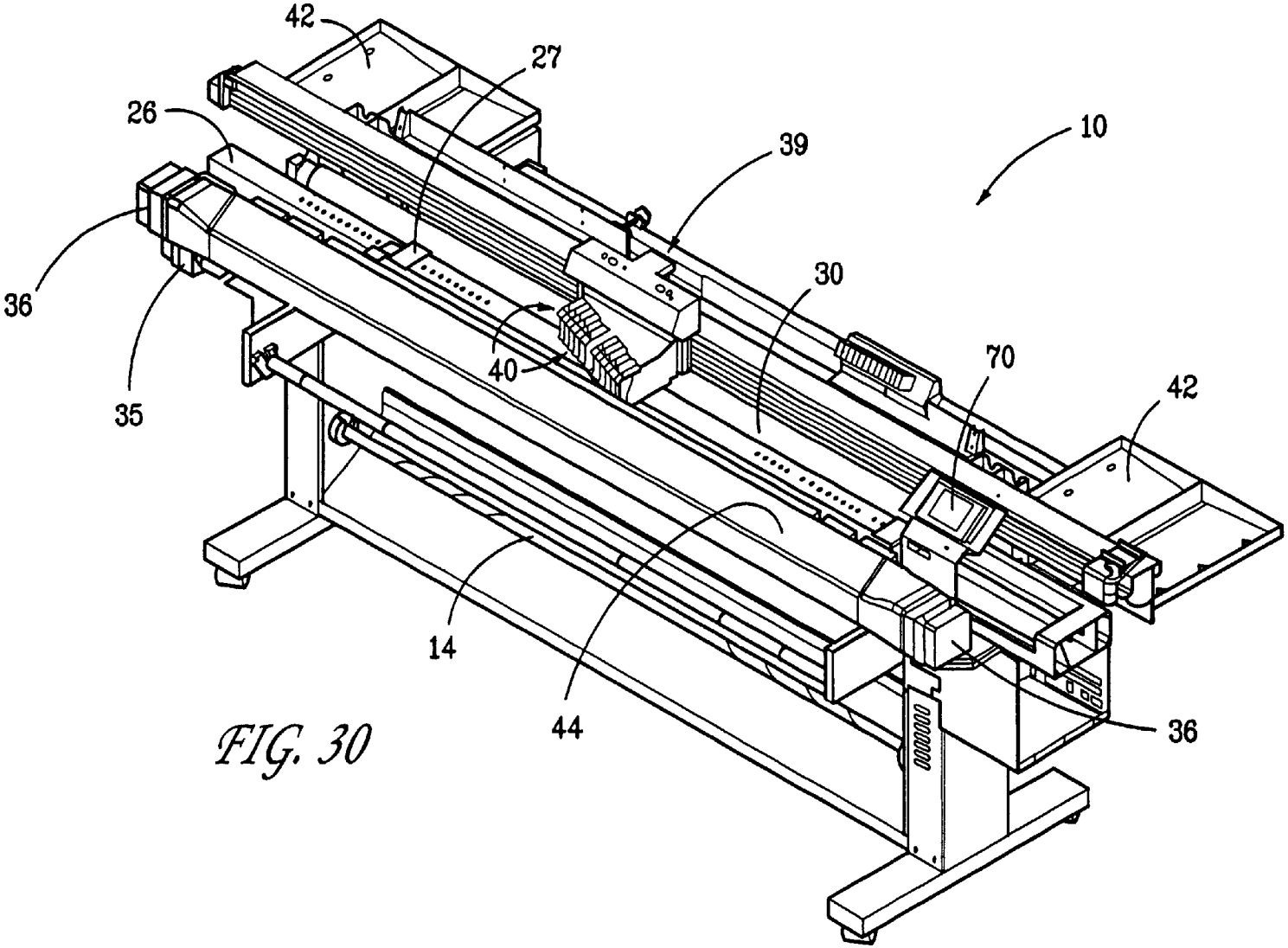
FIG. 30 is a perspective view of an ink jet print engine with parts removed for ease of viewing, which was designed and constructed according to the present invention and in which the dual sources of heated, forced air for the upperside dryer are clearly depicted.

FIG. 30 is a perspective view of an ink jet print engine with parts removed for ease of viewing, which engine 10 was designed and constructed according to the present invention and in which the dual sources of heated, forced air for the upperside dryer 44 are clearly depicted as is the reciprocating carriage assembly 39 having twelve print cartridge holding sockets therein in which twelve individual in jet cartridges 40 are electronically and physically coupled during printing operations.

Figure 31:
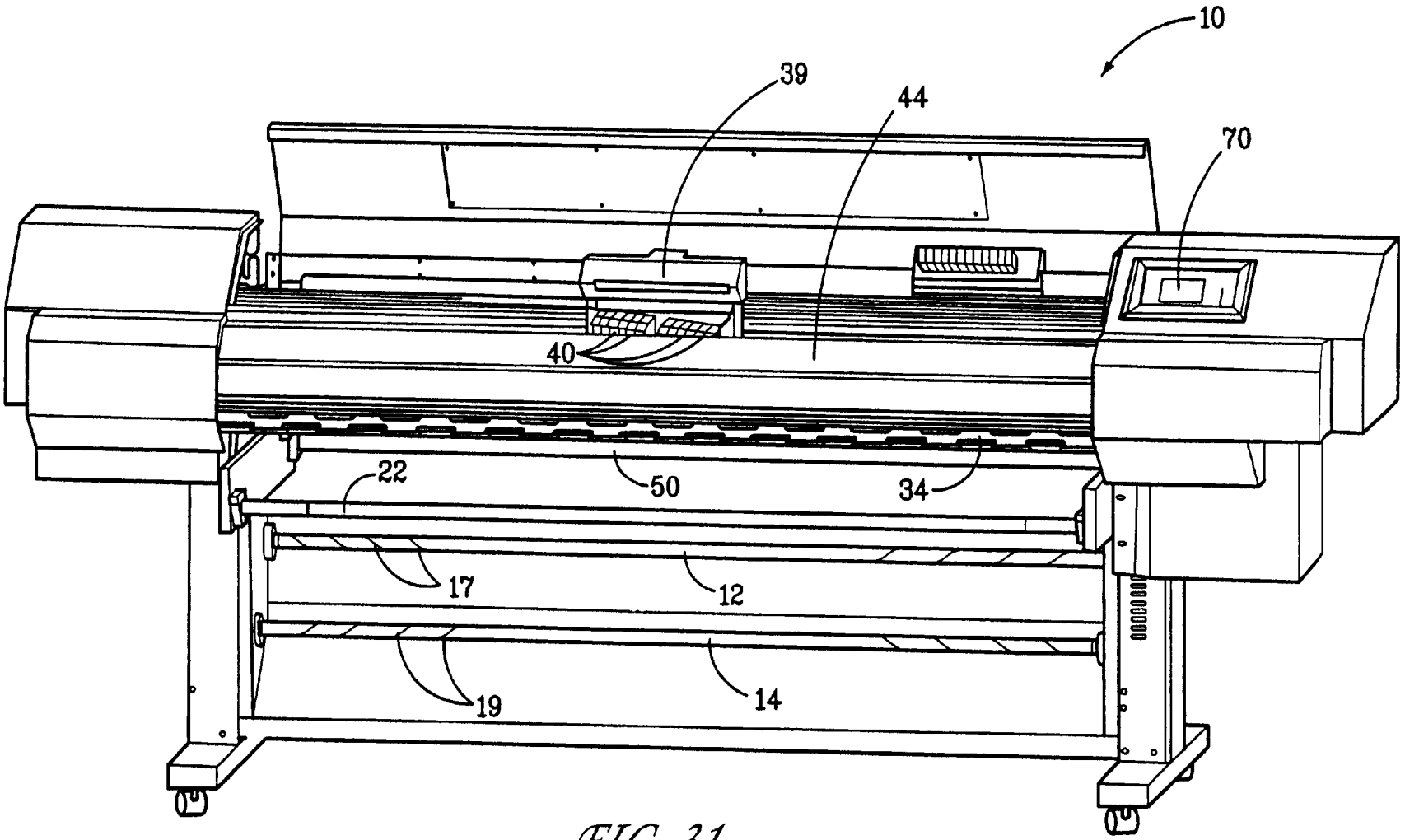
FIG. 31 is a perspective view of an ink jet print engine with parts removed for ease of viewing, which was designed and constructed according to the present invention and in which the dual sources of heated, forced air for the underside dryer are better depicted.

FIG. 31 is a perspective view of an ink jet print engine 10 with parts removed for ease of viewing, which was designed and constructed according to the present invention and in which the dual sources of heated, forced air for the underside dryer are better depicted as is the touch pad control input pod 70 usable in a preferred embodiment of the present invention.

Figure 32:
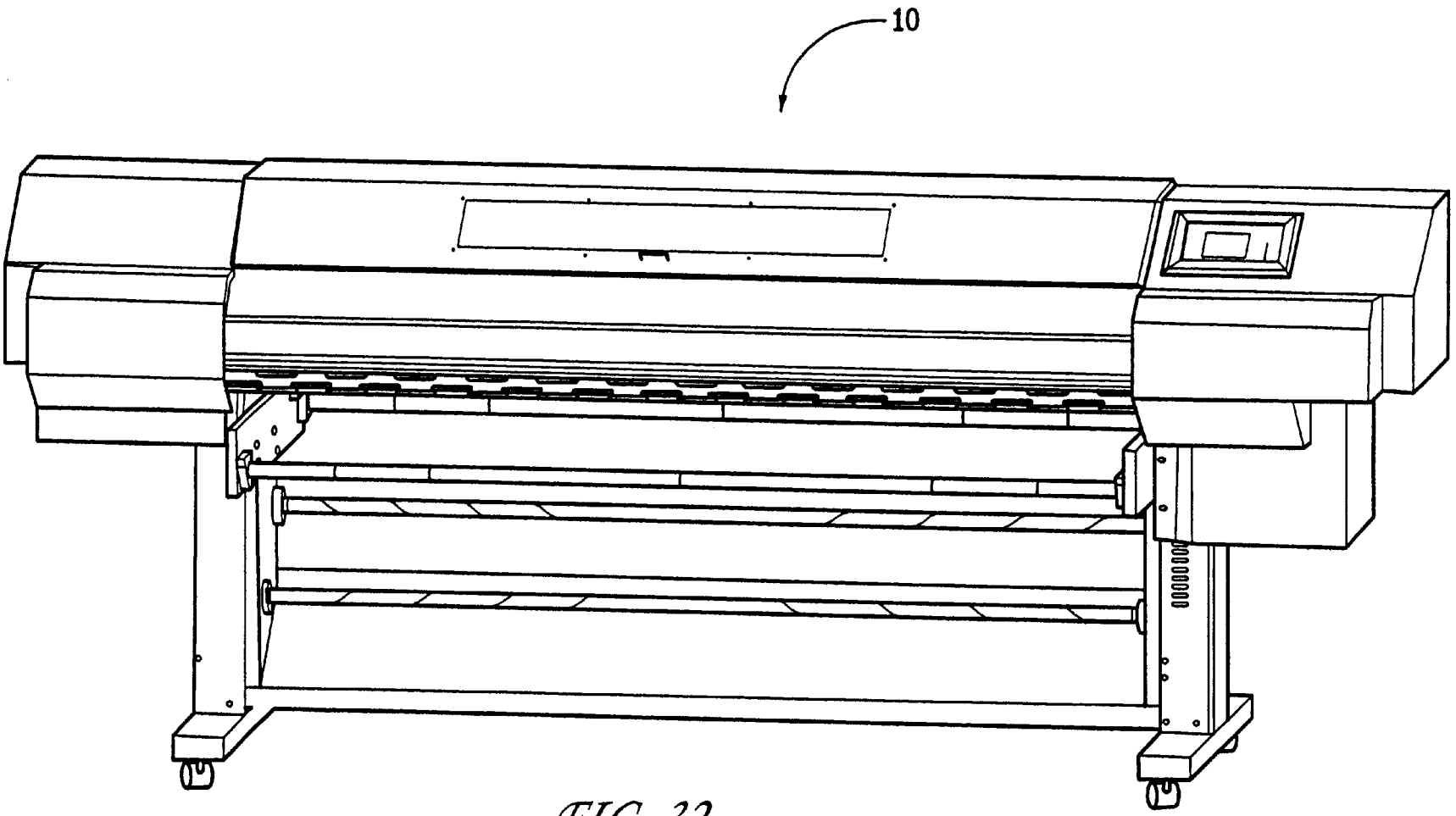
FIG. 32 is a perspective view of the frontal portion of a print engine designed and constructed in accordance with the present invention depicting a chassis cover and end caps in place for printing operations (although no media is depicted in FIG. 32).

FIG. 32 is a perspective view of the frontal portion of a print engine 10 designed and constructed in accordance with the present invention depicting a chassis cover and end caps in place for printing operations (although no media is depicted in FIG. 32).

Figure 33:
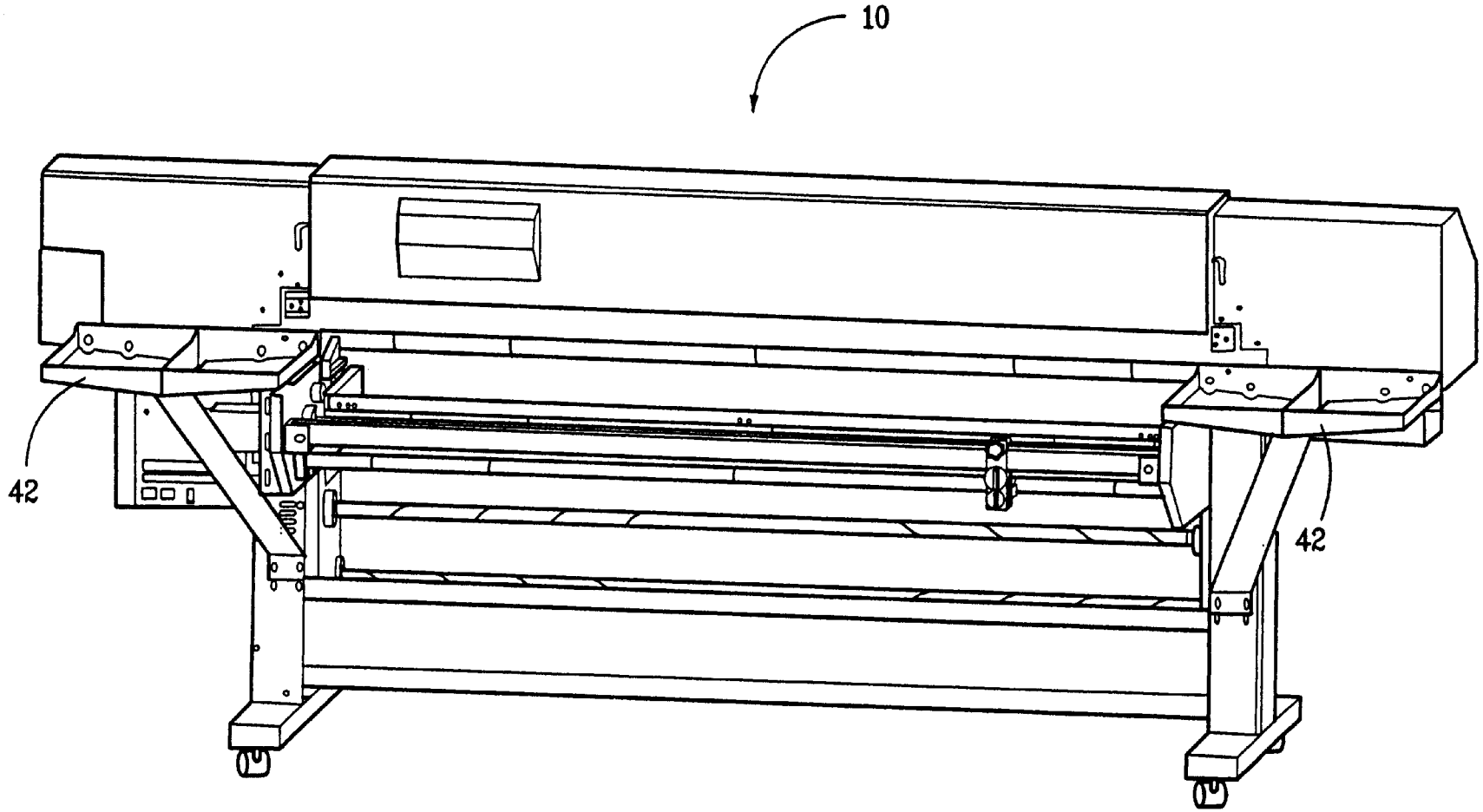
FIG. 33 is a perspective view of a rear portion of a print engine designed and constructed in accordance with the present invention depicting a chassis cover and end caps in place for printing operations (although no media nor corded material on the pair of coss-web-inducing powered rollers are depicted in FIG. 33).

FIG. 33 is a perspective view of a rear portion of a print engine 10 designed and constructed in accordance with the present invention depicting a chassis cover and end caps in place for printing operations (although no media nor corded material on the pair of cross-web-inducing powered rollers are depicted in FIG. 33). Two sets of ink reservoir support trays 42 appear at each end of the engine 10.

The inks usable with the present textile print engine 10 include reactive inks, acid inks, dye-based, pigment-based, and dye sublimation inks each of which is suitably formulated for emission from an ink jet print head. The ink jet print head may comprise any of the thermal ink jet print heads exemplified by those designed and manufactured by Hewlett-Packard Company of Palo Alto, Calif., USA. Also, a variety of piezoelectric print heads may be used to emit ink from a reciprocating carriage that traverses over the open-web print zone of the present invention. In most cases, the printed textile media will need some measure of post print treatment to fix the colorant to the textile fibers such as steaming, washing, or exposure to radiation, to name a few means of fixing the colorant.

With respect to the idler rollers and grit rollers used herein, a slight convex shape may be advantageously employed to impart a slight center web tension as the media is advanced through the print engine 10. Either all or a select few of the idler rollers may for example be milled with a thousandth of an inch crown (0.001") or more, as desired with advantageous results particular for textile media that has a lot of stretch when mounted to the print engine 10. The media is preferably center-justified, or mounted at the center of the spools, idler rollers, and grit rollers used herein so such a 'crowning' technique will not cause any undue distortion to the media during printing. This center justified technique also creates a measure of tolerance for poorly wound textile supplies (which to date have not been manufactured to standard graphics-arts ink jet standards) which tend to "walk" and wander as they are unwound from the supply spool 12. Furthermore, since the center core(s) materials used in the traditional textile manufacturing processes are not always uniform, the present print engine 10 is capable of retaining multi-sized and multi-part cores and still imparting the slight opposing forces preferred for the supply spool 12 and take-up spool 14.

As with most all ink jet printing techniques, the present invention preferably utilizes a service station for wiping, spitting, and capping the ink emitting portions of the ink jet cartridge, or print heads. The present invention utilizes a service station that is activated by a pin member formed into the carriage assembly so that as the carriage traverses into the service station end of (next to the print zone) the service station is articulated upward. When the service station platform is elevated slightly a small motor is energized to turn a lead screw and drive the station orthogonally to the carriage axis during the wiping portion of the service station visit. Thus, the ink emitting nozzles are preferably wiped in a direction that corresponds to the linear array(s) in which the nozzles are oriented. The net result is that the ink from the nozzles is wiped across the nozzle array and to a non-ink receiving portion of the print head, thus avoiding contamination of the sensitive electronics and flex-circuits proximate the nozzle arrays. Preferably the service station platform is mounted to a 'rack and pinion' type suspension near each end of the service station with the driving motor located at or near a center point. In this way, the entire service station is efficiently and economically articulated during the wiping function.

The present engine 10 preferably is coupled to a raster image processor (RIP) which is used to translate digital image files from a first format to a set of swaths for printing using a set of discretely colored inks as is known and used in the art. A preferred RIP is the ColorMark® Pro series of print servers running ColorMark® Pro series of print servers running ColorMark® color management software developed and distributed by ColorSpan Corporation, Eden Prairie, Minn. USA. The ink jet cartridges used in conjunction with the present invention are preferably coupled to Big Ink® delivery system ink sets also patented, manufactured, and sold by ColorSpan Corporation. These Big Ink bulk ink delivery sets have high volume ink reservoirs coupled to the cartridges via flexible tubing and the reservoirs are supported on reservoir shelves oriented to maintain the preferred hydrodynamic condition(s) of a given ink jet cartridge.

In summary, the present inventive large format digital print engine for use in printing upon textile media substrates is characterized by the following unique features:

Use of opposing low torque motors driving the supply and take-up;

Open web print zone;

Full web powered grit roller;

Adjustable salvage edge maintenance members;

Center-justified media loading and printing configuration;

"Auto-locking" nip roller assembly proximate the full-web grit roller member for ease of media loading;

Orthogonal-wipe activated service station;

Manual technique for calibration of the print heads;

Underside drying technique(s)—alone and dual (combination);

Pause/resume printing capability (with 'auto media marking'?);

Media advance algorithms (removes all 'play' at start);

Optical encoder which compensates for accel/decel;

Dual screw cross-web tensioning apparatus (1st);

Adjustable wheel-based cross-web tensioning apparatus (2nd);

Extruded print-zone-edge member (with integral cutter path); &

File edge cache technique (for consistent non-printed edges).

Although that present invention has been described with reference to discrete embodiments, no such limitation is to be read into the claims as they alone define the metes and bounds of the invention disclosed and enabled herein. One of skill in the art will recognize certain insubstantial modifications, minor substitutions, and slight alterations of the apparatus and method claimed herein, that nonetheless embody the spirit and essence of the claimed invention without departing from the scope of the following claims.

The following Examples are intended as illustrative of a select few embodiments of the present invention and should not be construed to limit the strength, scope, and boundaries of the present invention in any manner, since it the appended claims themselves that define the metes and bounds of the invention claimed herein.

EXAMPLE

A large format digital print engine having a printing zone where ink is dispensed onto a fibrous media substrate as such substrate is suspended between two supporting members, comprising:

a printing print zone frame member disposed at a first elevation;

a first edge portion for supporting a portion of a printing media spaced above said frame member at a second elevation;

a second edge portion for supporting a second portion of the printing media spaced above said frame member at the second elevation wherein the second edge portion is adapted to receive a cutting edge;

wherein a fraction of the surface area of the printing media supported between the first edge portion and the second edge portion defines a printing zone;

printing media advancement means for propelling the printing media from the first edge portion through the printing zone and then to the second edge portion; and ink dispensing means for dispensing a marking material onto the printing media in the printing zone.

A large format digital print engine having a printing zone where ink is dispensed onto a fibrous media substrate as such substrate is suspended between two supporting members, comprising:

a printing print zone frame member disposed at a first elevation;

a first edge portion for supporting a portion of a printing media spaced above said frame member at a second elevation;

a second edge portion for supporting a second portion of a printing media spaced above said frame member at the second elevation;

wherein a fraction of the surface area of the printing media supported between the first edge portion and the second edge portion defines a printing zone;

printing media advancement means for propelling the printing media from the first edge portion through the printing zone and then to the second edge portion; and ink dispensing means for dispensing a marking material onto the printing media in the printing zone.

EXAMPLE

One of the large format digital print engines previously defined and further including at least one salvage edge member adjustably coupled to the frame member and disposed to passively retain an edge region of the printing media.

EXAMPLE

A large format digital print engine previously defined wherein the first edge is a rotating grit roller and the grit roller has a width dimension greater than the width of the printing media.

EXAMPLE

A large format digital print engine hereof wherein the grit roller is powered to rotate precisely by an electric motor coupled to the grit roller at an axis of rotation of said grit roller.

EXAMPLE

Figure 34:
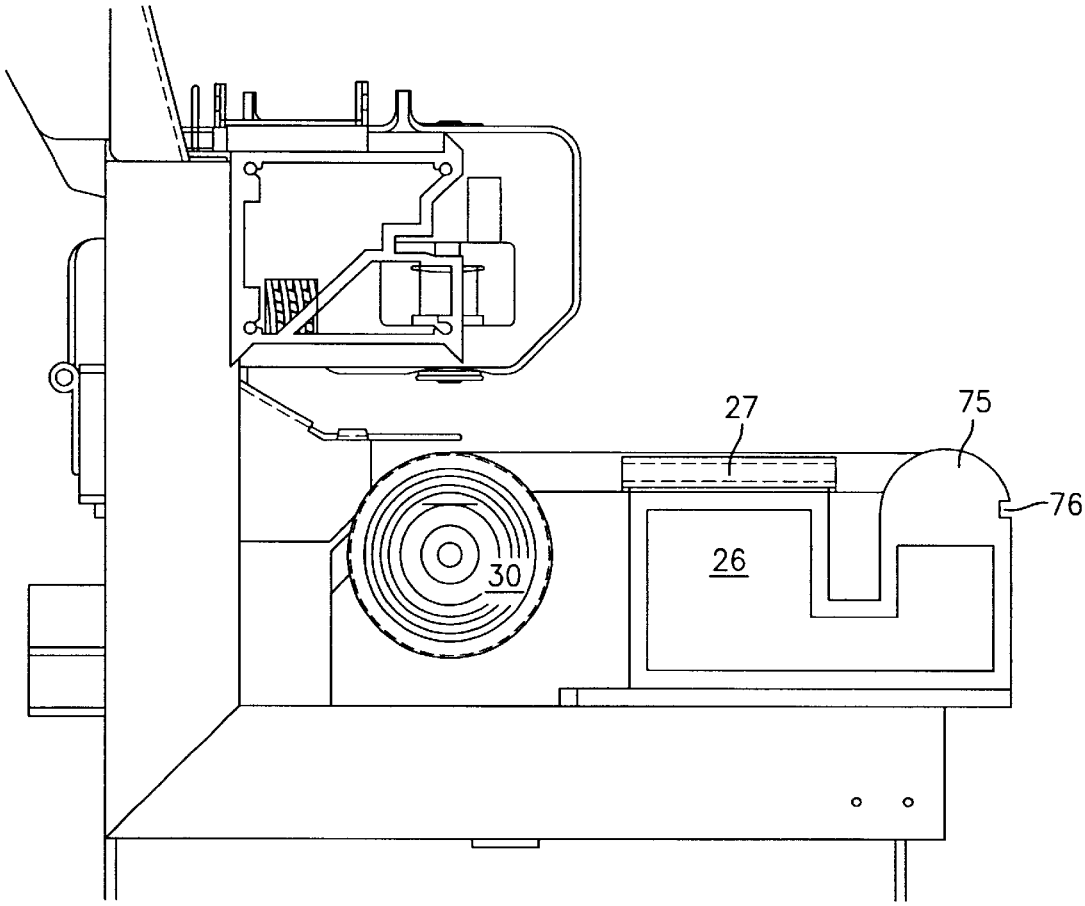
FIG. 34 depicts an embodiment wherein an extruded portion of the print zone frame member for replaces the passive full-web idler roller and wherein the extruded portion has an axial groove for receiving a cutting instrument.

The large format digital print engine hereof wherein the grit roller is powered to rotate precisely by an electric motor having an integral optical encoder that provides an output feedback signal provided to a print head control circuit and wherein the grit roller is coated with a material which promotes friction with the printing media. cl EXAMPLE The large format digital print engine hereof wherein the first edge is a powered roller 30 which is powered to rotate precisely by an electric motor coupled to the grit roller at an axis of rotation of said grit roller and the second edge is an edge 75 having an axial groove 76 oriented orthogonal to a print media advancement direction receiving the cutting instrument (not shown) thereacross, as shown in FIG. 34.

EXAMPLE

The large format digital print engine hereof, further including an absorbing means, removeably disposed on the frame member at the first elevation in the printing zone, for reducing the amplitude of a periodic sinusoidal fluctuations in the printing media and for receiving any marking material that penetrates through the printing media.

EXAMPLE

The large format print engine hereof, wherein the absorbing means is a layer of absorbent fibers formed into a pad and wherein the pad is adhered to the frame member.

EXAMPLE

The print engine hereof, wherein the at least one salvage edge is adjustably coupled to the frame member so that the at least one salvage edge member restricts movement of the printing media at a selectable horizontal location and vertical elevation.

Although that present invention has been described with reference to discrete embodiments, no such limitation is to be read into the claims as they alone define the metes and bounds of the invention disclosed and enabled herein. One of skill in the art will recognize certain insubstantial modifications, minor substitutions, and slight alterations of the apparatus and method claimed herein, that nonetheless embody the spirit and essence of the claimed invention without departing from the scope of the following claims.

What is claimed is:

1. A large format digital print engine having a printing zone where ink is dispensed onto a fibrous media substrate as such substrate is suspended between two supporting members, comprising:

a printing print zone frame member disposed at a first elevation;

a first edge portion for supporting a portion of a printing media spaced above said frame member at a second elevation;

a second edge portion for supporting a second portion of said printing media spaced above said frame member at the second elevation;

wherein a fraction of the surface area of the printing media supported between the first edge portion and the second edge portion defines a printing zone, and a clearance is formed below said printing zone between said frame member at said first elevation and said printing media spaced above said frame member at the second elevation;

printing media advancement means for propelling the printing media from the first edge portion through the printing zone and then to the second edge portion; and ink dispensing means for dispensing a marking material onto the printing media in the printing zone.

2. The large format digital print engine of claim 1, further comprising.

at least one salvage edge member adjustably coupled to the frame member and disposed to passively retain only an edge region of the printing media while the printing media is in the printing zone to prevent curling of the printing media edge region.

3. The print engine of claim 2, wherein the at least one salvage edge member comprises a lower side connected to the frame member at said first elevation and an upper side connected to said edge portion of said printing media proximate said second elevation, and wherein the at least one salvage edge member is adjustably coupled to the frame member so that the at least one salvage edge member restricts movement of the printing media at a selectable horizontal location and vertical elevation in said printing zone.

4. The large format digital print engine of claim 1 wherein said first edge portion is a rotating grit roller and said grit roller has a width dimension greater than the width of said printing media.

5. The large format digital print engine of claim 4, wherein the grit roller is powered to rotate precisely by an electric motor coupled to the grit roller at an axis of rotation of said grit roller.

6. The large format digital print engine of claim 4, wherein the grit roller is powered to rotate precisely by an electric motor having an integral optical encoder that provides an output feedback signal provided to a print head control circuit and wherein the grit roller is coated with a material which promotes friction with the printing media.

7. The large format digital print engine of claim 1, wherein the first edge portion is a powered grit roller which is powered to rotate precisely by an electric motor coupled to the grit roller at an axis of rotation of said grit roller and the second edge is an idler roller.

8. The large format digital print engine of claim 1, further comprising an absorbing means, removeably disposed on the frame member at the first elevation in the printing zone, for reducing the amplitude of a periodic sinusoidal fluctuations in the printing media and for receiving any marking material that penetrates through the printing media.

9. The large format print engine of claim 8, wherein the absorbing means is a layer of absorbent fibers formed into a pad and wherein the pad is adhered to the frame member.

10. A large format digital print engine having a printing zone where ink is dispensed onto a fibrous media substrate as such substrate is suspended between two supporting members, comprising:

a printing print zone frame member disposed at a first elevation;

a first edge portion for supporting a portion of a printing media spaced above said frame member at a second elevation;

a second edge portion for supporting a second portion of a printing media spaced above said frame member at the second elevation;

wherein a fraction of the surface area of the printing media supported between the first edge portion and the second edge portion defines an open web printing zone;

printing media advancement means for propelling the printing media from the first edge portion through the open web printing zone and then to the second edge portion; and ink dispensing means for dispensing a marking material onto the printing media in the open web printing zone.

11. The large format digital print engine of claim 10, further comprising:

at least one salvage edge member adjustably coupled to the frame member and disposed to passively retain only an edge region of the printing media while the printing media is in the printing zone to prevent curling of the printing media edge region.

12. The print engine of claim 11, wherein the at least one salvage edge member comprises a lower side connected to the frame member at said first elevation and an upper side connected to said edge portion of said printing media proximate said second elevation, and wherein the at least one salvage edge member is adjustably coupled to the frame member so that the at least one salvage edge member restricts movement of the printing media at a selectable horizontal location and vertical elevation in said printing zone.

13. The large format digital print engine of claim 10, wherein the first edge is a roller and the roller has a width dimension greater than the width of the printing media.

14. The large format digital print engine of claim 13, wherein the roller is powered to rotate precisely by an electric motor coupled to the roller at an axis of rotation of said roller.

15. The large format digital print engine of claim 13, wherein the roller is powered to rotate precisely by an electric motor having an integral optical encoder that provides an output feedback signal provided to a print head control circuit and wherein the roller is coated with a material which promotes friction with the printing media.

16. The large format digital print engine of claim 10, wherein the first edge is a powered roller which is powered to rotate precisely by an electric motor coupled to the powered roller at an axis of rotation of said roller and the second edge is an idler roller.

17. The large format digital print engine of claim 10, further comprising an absorbing means, removeably disposed on the frame member at the first elevation in the printing zone, for reducing the amplitude of a periodic sinusoidal fluctuations in the printing media and for receiving any marking material that penetrates through the printing media.

18. The large format print engine of claim 17, wherein the absorbing means is a layer of absorbent fibers formed into a pad and wherein the pad is adhered to the frame member.

19. The print engine of claim 10 wherein the first edge is a powered roller which is powered to rotate precisely by an electric motor coupled to the roller at an axis of rotation of said roller and the second edge is an edge having an axial groove oriented orthogonal to a print media advancement direction for receiving a manual cutting instrument.

20. The print engine of claim 10 wherein the ink dispensing means is at least eight ink jet print heads and the at least eight ink jet print heads are disposed in a reciprocating carriage assembly.

* * * * *